US009694876B1

(12) United States Patent
Smith

(10) Patent No.: US 9,694,876 B1
(45) Date of Patent: Jul. 4, 2017

(54) PIVOTING MAST DEVICE AND METHOD

(71) Applicant: Donald E. Smith, Sarasota, FL (US)

(72) Inventor: Donald E. Smith, Sarasota, FL (US)

( * ) Notice: Subject to any disclaimer, the term of this patent is extended or adjusted under 35 U.S.C. 154(b) by 0 days.

(21) Appl. No.: 15/225,223

(22) Filed: Aug. 1, 2016

Related U.S. Application Data

(60) Provisional application No. 62/199,099, filed on Jul. 30, 2015.

(51) Int. Cl.
*B63B 15/00* (2006.01)

(52) U.S. Cl.
CPC .. *B63B 15/0083* (2013.01); *B63B 2015/0058* (2013.01)

(58) Field of Classification Search
CPC ..... B63B 2015/0016; B63B 2015/005; B63B 2015/0058; B63B 2015/0066; B63B 2015/0075; B63B 15/02
See application file for complete search history.

(56) References Cited

U.S. PATENT DOCUMENTS

| | | | | |
|---|---|---|---|---|
| 3,827,386 | A | 8/1974 | Faden | |
| 3,898,948 | A | 8/1975 | Huff | |
| 4,112,861 | A * | 9/1978 | Lewis | B63B 15/0083 114/39.32 |
| 4,159,006 | A * | 6/1979 | Thurston | B63B 1/14 114/123 |
| 4,259,917 | A | 4/1981 | Frank | |
| 4,624,204 | A | 11/1986 | Temple | |
| 4,655,154 | A | 4/1987 | Leonard | |
| 4,694,769 | A | 9/1987 | Sowers | |
| 4,718,370 | A | 1/1988 | Portell-Vila | |
| 4,774,477 | A | 9/1988 | Rodes et al. | |
| 4,938,161 | A | 7/1990 | Blackmer | |
| 4,940,008 | A | 7/1990 | Hoyt | |
| 5,042,412 | A * | 8/1991 | Fouch | B63B 35/7933 114/39.17 |
| 5,865,136 | A | 2/1999 | Alexander | |
| 6,990,916 | B1 | 1/2006 | Atwood, Jr. | |
| 7,341,014 | B2 | 3/2008 | Smith | |
| 7,418,911 | B2 | 9/2008 | McClintock | |

(Continued)

FOREIGN PATENT DOCUMENTS

| | | | | |
|---|---|---|---|---|
| EP | 2184223 | A2 | 5/2010 | |
| FR | 2810626 | A1 * | 12/2001 | B62B 15/0083 |

(Continued)

*Primary Examiner* — Andrew Polay
(74) *Attorney, Agent, or Firm* — Frijouf, Rust & Pyle, P.A.

(57) ABSTRACT

A pivoting mast device is disclosed for pivoting a mast relative to a surface. The pivoting mast device comprises a mast pivot pivotably coupling the mast to the surface. A lower wheel is rotatably coupled adjacent to a proximal end of the mast. An upper wheel is rotatably coupled adjacent to a distal end of the mast. A linkage couples the lower wheel to the upper wheel. A drive is coupled to the lower wheel for displacing the linkage. An upper traveler slideably engages the mast and is coupled to the headstay. A lower traveler slidably engages the mast and is coupled to the linkage. A lowering stay is secured to the surface and the lowering traveler. A mast lowering displacement is defined by the lower traveler and the upper traveler in a descending direction. A mast raising displacement is defined by the lower traveler in a ascending direction.

10 Claims, 27 Drawing Sheets

(56) References Cited

U.S. PATENT DOCUMENTS

| | | | |
|---|---|---|---|
| 7,614,356 | B2 | 11/2009 | Knisely et al. |
| 2008/0141918 | A1 | 6/2008 | McClintock |
| 2011/0100278 | A1 | 5/2011 | McClintock |
| 2013/0319311 | A1 | 12/2013 | Balfour |

FOREIGN PATENT DOCUMENTS

| | | | | |
|---|---|---|---|---|
| SE | EP 2184223 | A2 * | 5/2010 | ..... B63B 15/0083 |
| WO | WO8702322 | A1 | 4/1987 | |
| WO | WO2009074832 | A2 | 6/2009 | |

* cited by examiner

PIVOTING MAST DEVICE AND METHOD

CROSS-REFERENCE TO RELATED APPLICATIONS

This application claims benefit of U.S. Patent Provisional Application No. 62/199,099 filed Jul. 30, 2015. All subject matter set forth in Provisional Application No. 62/199,099 is hereby incorporated by reference into the present application as if fully set forth herein.

BACKGROUND OF THE INVENTION

Field of the Invention

This invention relates to masts and more particularly to a pivoting mast device and method.

Background of the Invention

The height of sailboat masts has been a perennial problem for the sailing enthusiast, regardless of the size of the vessel. Even the owners of the smallest of sailboats which can easily be trailered may require more than one person to raise and lower the mast. The larger the vessel, the more difficult the task becomes with an increased probability of an accident which may result in equipment and/or personnel injury. After the vessel is rigged and underway, at times there is a need to lower the mast to proceed under a fixed bridge or the like.

The need has been well established for a dependable, easy to use apparatus for safely raising and lowering the mast on a sailboat. There have been many in the prior art who have attempted to solve these problems with varying degrees of success. None, however completely satisfies the requirements for a complete solution to the aforestated problem. The following U. S. Patents are attempts of the prior art to solve this problem.

U.S. Pat. No. 3,827,386 to Faden discloses a means for lowering the mast on a sailboat without requiring any adjustment or release of the shrouds, stays or sails. The invention comprises vertical support means pivotally secured at one end to the hull of the sailboat, the second end being pivotally secured to an intermediate position on a mast, the lower end of the mast being pivotally and slidably secured to the hull of the sailboat.

U.S. Pat. No. 4,112,861 to Lewis discloses a sailboat hull including an upright mast having upper and lower end portions. First structure pivotally supports the lower end of the lower end portion of the mast from the hull for swinging between an upright position and a lowered position with the upper end of the lower end portion swung toward one end of the hull. Second structure pivotally supports the lower end of the upper end portion from the upper end of the lower end portion for swinging between an upright position and a lowered position with the upper end of the upper end portion swung toward the other end of the hull. Third structure is operatively connected between the upper and lower end portions of the mast and the hull operative for sequentially controllably lowering the lower end portion from its upright position to its lowered position while maintaining the upper end portion upright and thereafter controllably lowering the upper end portion from its upright position to its lowered position and for sequentially controllably raising the upper end portion from its lowered position to an upright position and thereafter controllably raising the lower end portion from its lowered position to its upright position while maintaining the upper end portion of the mast upright.

U.S. Pat. No. 4,259,917 to Frank discloses a foldable mast assembly for sailboats wherein a main mast is pivotably connected to a stub mast which is pivotally connected to a base secured to the sailboat deck. A removable pin extends between the stub mast and base whereby the main mast and stub mast may be folded to an inoperative position substantially parallel to the main deck and centered approximately lengthwise of the sailboat. The folding and raising of the main and stub masts are controlled by a cable received through sheaves carried on the main and stub masts, one end of the cable being connected to the fore deck near the bow of the sailboat and the other end connected to a power winch on the aft deck of the sailboat. In smaller sailboats, having small masts where cables and sheaves are not required, the folding and raising of the main and stub masts can be accomplished manually.

U.S. Pat. No. 4,655,154 to Leonard discloses a collapsible mast assembly for a sailboat including a mast support which is mounted on the boat deck for supporting the lower end of the mast. The support includes upstanding side walls and a lower rear wall to which the boom is attached. A mast plate is mounted within the mast support at the bottom thereof and is adapted to fit within the open lower end of the tubular mast. The mast is lowered by loosening its stays and then lifting the same until its bottom is above the level of the mast plate. At that point the mast can be tilted backward toward a horizontal position where it rests and pivots on the top of the rear wall as the bottom of the mast pivots upwardly through the open front of the mast support. In the horizontal position, the mast can be moved rearwardly or forwardly as desired. The boom is secured to the rear of the mast support so that movement of the mast is independent of the boom.

U.S. Pat. No. 4,718,370 to Portell-Vila discloses a mast raising mechanism operating on a hinged mast and including an elongated base section that is removably attached to the lower mast section that is uprightly affixed in the boat. An elongated extender section is telescopically extended from the base section and is locked in place. A pulley is mounted at the top of the extender section. A line, attached to the mid region of the mast, passes over the top of the pulley and the end of the line is acted on by a crank which is on the base section. Due to the height of the base section plus extender section, and due to the angle of the line, a person can easily wind up the line and raise the mast.

U.S. Pat. No. 4,938,161 to Blackmer discloses an improved hoisting apparatus for a sailboard rig of the type which is attached to a sailboard with a universal connection. The improved hoisting apparatus comprises a hoist pole with a bottom end and a top end, an attachment connecting the bottom end of the hoist pole to the mast to provide pivotable and rotational movement of the hoist pole with respect to the mast. A halyard including first and second tension members extends from the top end of the hoist pole. The first tension member is connected to the boomhead, and the second tension member has a graspable end portion for exerting a force on the hoist pole to hoist the rig. Elastic cord members are connected to return the hoisting apparatus to a stowage position when the graspable end portion is released. A third tension member connects the bottom end of the hoist pole to the boomhead so as to transfer the axial force component on the hoist pole caused by hoisting forces to the boomhead, thereby requiring the bottom end attachment to sustain only transverse force components. In one embodiment, the first and second tension members are furnished by a single uphaul passing freely through a guide ring in the top end of the hoist pole.

U.S. Pat. No. 5,865,136 to Alexander discloses a system and method providing a portable sailboat mast hoisting crane which is safe, light weight, easily assembled, easily disassembled, and operable by one man. The crane can be locked down for security on the frame of the boat trailer for storage. The mounting mechanism is universally compatible with most pleasure craft sailboats, and does not require alternation or permanent modifications to the vessel.

U.S. Pat. No. 7,341,014 to Smith discloses a system for one person raising and lowering the mast of a sailboat wherein the mast is less than about forty feet in length and in the down position the mast is laid horizontally along a median line of the hull of a sailboat. The system includes rigging to raise the height of the mast from the hull and then to pivot the mast with the pivot being near the lowest point of the mast. Means is provided to pivot the mast about the lowest point of the mast until the mast is in a vertical position. The mast is then brought down into an upstanding vertical position with means to support the mast on the sailboat at the mast's lowest point and upwardly therefrom. The same rigging may be used to lower the mast to the horizontal. The operations occur by a winch located towards the rear of the sailboat to either pay out a line thereon when lowering the mast to the horizontal or conversely to take up the line when the mast is pivoted to the vertical.

U.S. Pat. No. 7,418,911 to McClintock discloses important design features and methods of launching a trailerable sailboat. The trailerable sailboat is designed to allow transportation on overland highways and to provide a simplified method of raising the mast without the need for a crane.

U.S. Pat. No. 7,614,356 to Knisely, et al. discloses a foldable mast assembly for a sailing vessel. The foldable mast assembly includes a lower mast section; an intermediate mast section having a lower end foldably coupled to an upper end of the lower mast section; an upper mast section having a lower end foldably coupled to an upper end of the intermediate mast section; and a boom coupled to the lower mast section. A locking device internal the mast assembly is also provided to inhibit folding of the mast assembly.

United States Patent Application 2011/0100278 to McClintock discloses an improvement in mast raising for a sailboat where a pivoting mast is raised or lowered rapidly by use of a pair of shroud struts, that are an integral part of the sailing rigging, all of which is done in a very stabilized manner.

United States Patent Application 2013/0319311 to Balfour discloses improvements to masts and in particular a mast apparatus for raising and/or lowering a mast on a vessel such as a vessel, and a vessel incorporating such a mast apparatus. In one example embodiment, the mast apparatus for raising and/or lowering the mast on a vessel comprises a mast; a mast housing; a pivot for the mast fixedly connected to the mast housing; a lateral movement control mechanism for enabling controllable lateral movement of the mast with respect to the pivot and the mast housing; a lateral movement control mechanism such as hydraulic ram connected to the mast and connected to the mast housing, or connected to the mast and connectable to a vessel, for driving the mast to rotate about the pivot and move laterally under the control of the lateral movement control mechanism so as to raise or lower the mast and move the mast laterally in a controlled manner.

Although the aforementioned prior art have contributed to the development of the art of raising and lowering a sailboat mast, none of these prior art patents have solved the needs of this art.

Therefore, it is an object of the present invention to provide an improved apparatus for raising and lowering the mast of a sailboat.

Another object of this invention is to provide an improved apparatus for raising and lowering the mast of a sailboat which is easy to use.

Another object of this invention is to provide an improved apparatus for raising and lowering the mast of a sailboat that can be retrofitted to existing sailboats.

Another object of this invention is to provide an improved apparatus for raising and lowering the mast of a sailboat that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved pivoting mast device for pivoting an elongated body relative to a surface. The improved pivoting mast comprises a mast extending between a proximal end and a distal end. A frontstay, a backstay, a right sidestay and a left sidestay extend from the mast to the surface. A mast pivot pivotably couples the mast to the surface between a vertical position and a non-vertical position. A lower wheel is rotatably coupled approximate to the proximal end of the mast. An upper wheel is rotatably coupled approximate to the distal end of the mast. A linkage couples the lower wheel to the upper wheel. A drive is coupled to the lower wheel for displacing the linkage in a descending direction or an ascending direction relative to the mast. An upper traveler slideably engages the mast and is coupled to the frontstay. A lower traveler slidably engages the mast and is coupled to the linkage. A lowering stay is secured to the surface and the lowering traveler. A vertical mast lock is defined by the lower traveler abutting the upper traveler during the upper traveler approximate to the distal end of the mast and the headstay, the backstay and the lowering stay in tension. A mast lowering displacement is defined by the lower traveler and the upper traveler in the descending direction for pivoting the mast from the vertical position to the non-vertical position. A mast raising displacement is defined by the lower traveler in the ascending direction for pivoting the mast from the non-vertical position to the vertical position.

In a more specific embodiment of the invention, a yoke mast extends between a proximal end and a distal end. A yoke pivot pivotably couples the proximal end of the yoke mast with the mast pivot for pivoting the yoke mast between a vertical position and a non-vertical position. The distal end of the yoke mast engages the lowering stay during the yoke mast in the vertical position for supporting the mast during a portion of the mast lowering displacement and a portion of the mast raising displacement.

In one embodiment of the invention, an upper traveler lock is coupled to the distal end of the mast. A locking arm extends from the upper traveler. The locking arm engages the upper traveler lock during the mast in the vertical position for preventing the descending displacement of the upper traveler.

The invention is also incorporated into the method of pivoting an elongated body relative to a surface. The method comprising the steps of activating a drive coupled to a mast for displacing a linkage in a descending direction. A lower traveler is slideably displaced engaging the mast and coupled to the linkage. An upper traveler is slideably displaced engaging the mast and coupled to the frontstay. The mast is pivoted on a mast pivot in a mast lowering displacement defined by the lower traveler and the upper traveler in the descending direction from the vertical position to the non-vertical position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
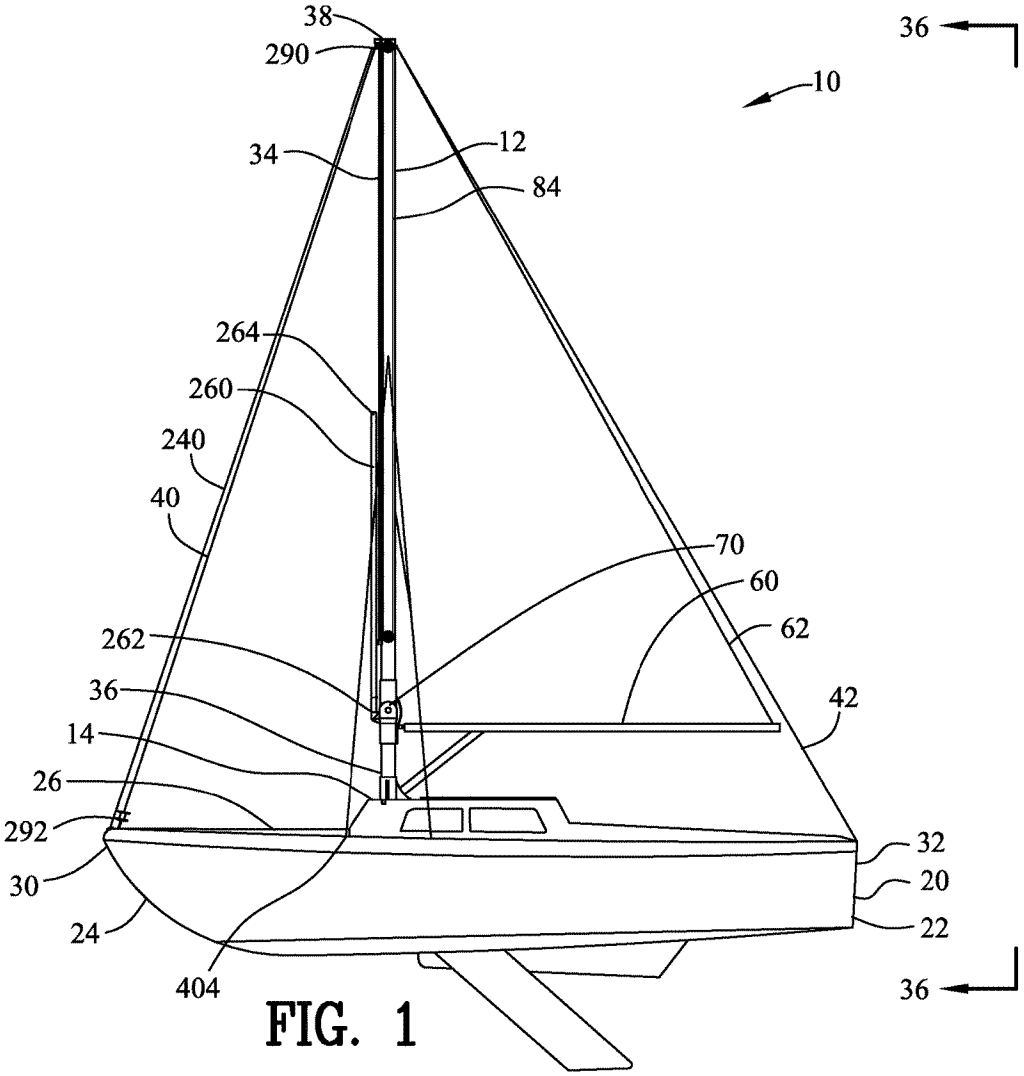
FIG. 1 is an elevated view of a pivoting mast device for pivoting a mast on a sailing vessel.
Figure 2:
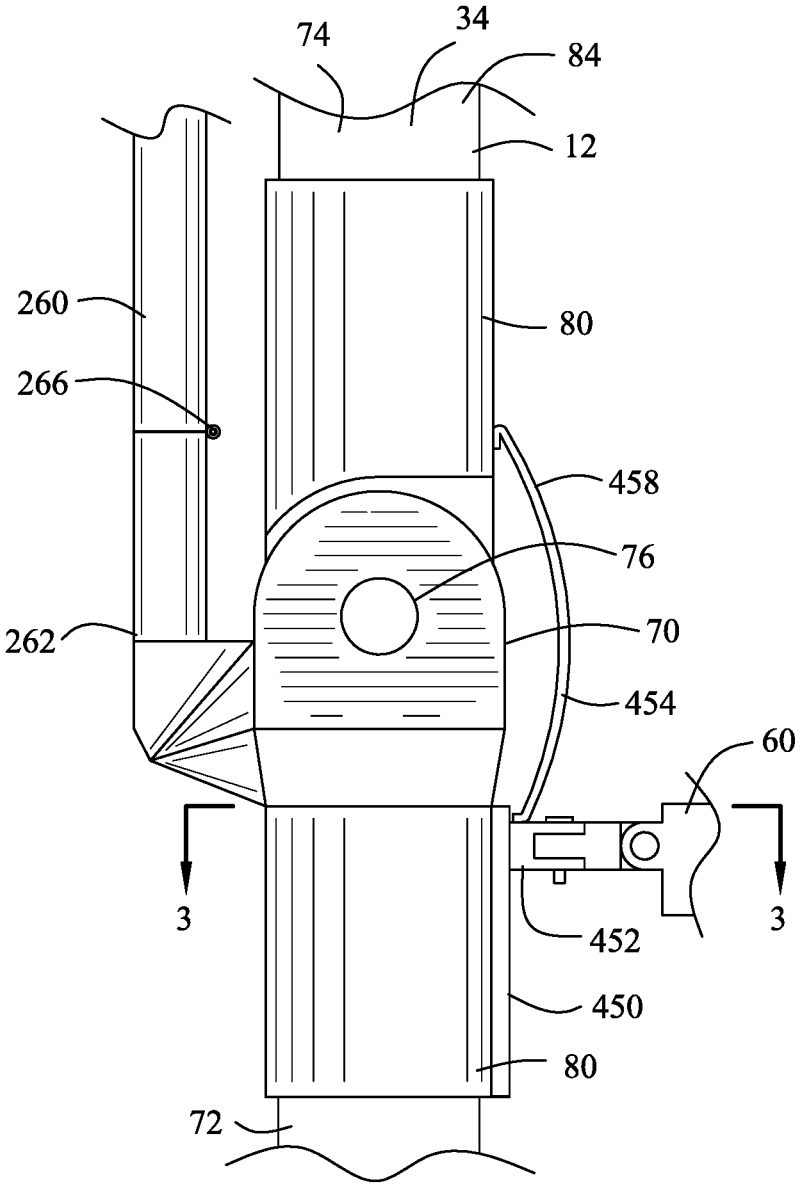
FIG. 2 is an enlarged portion of FIG. 1 illustrating a mast pivot having a boom slide engaging a boom.
Figure 3:
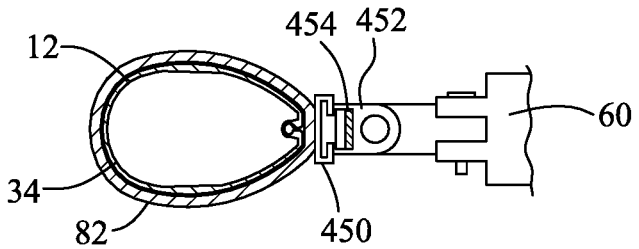
FIG. 3 is a sectional view along line 3-3 in FIG. 2.
Figure 4:
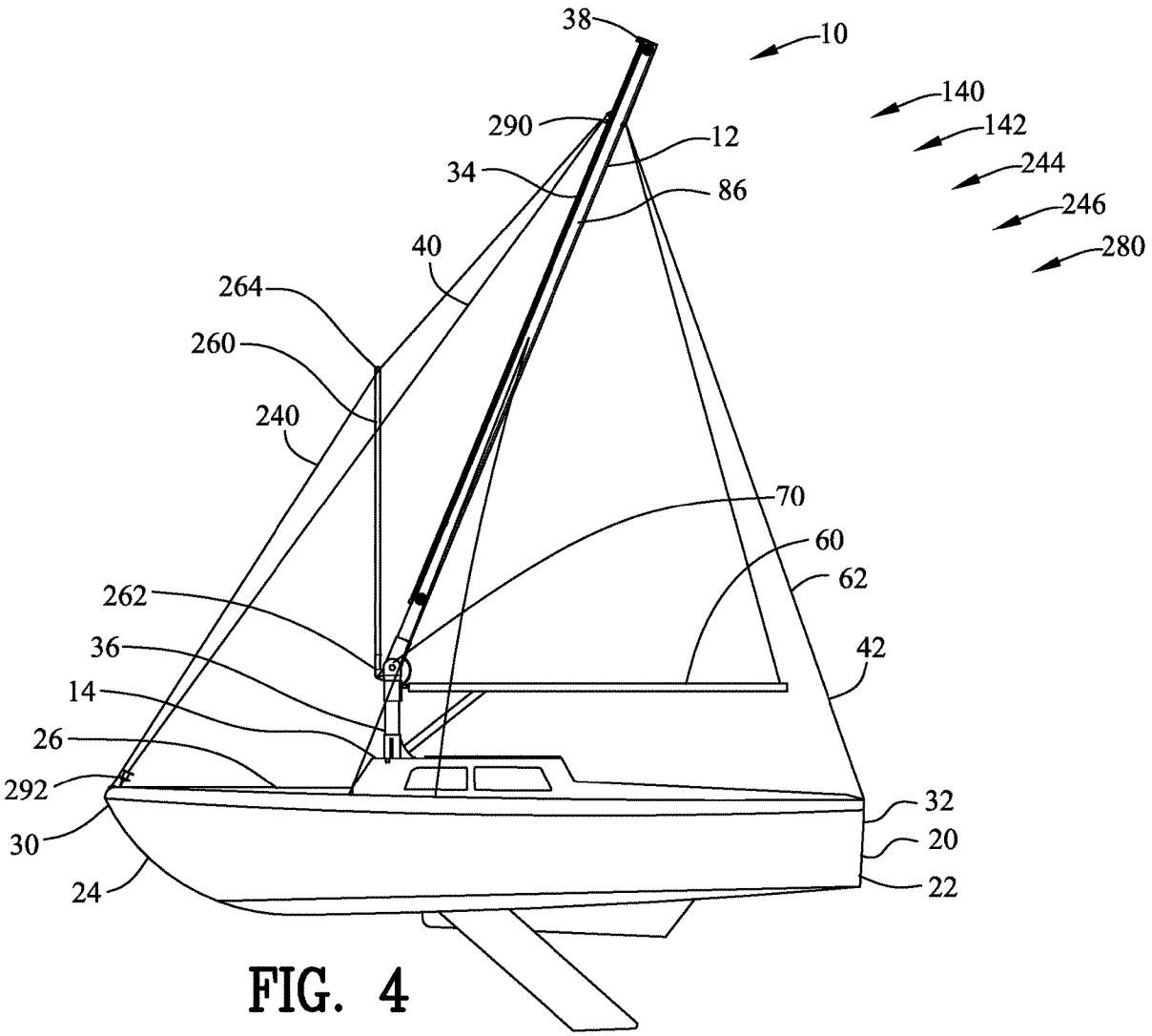
FIG. 4 is a view similar to FIG. 1 illustrating the mast having a partially lowering displacement from a vertical position and a yoke mast maintaining a vertical position.
Figure 5:
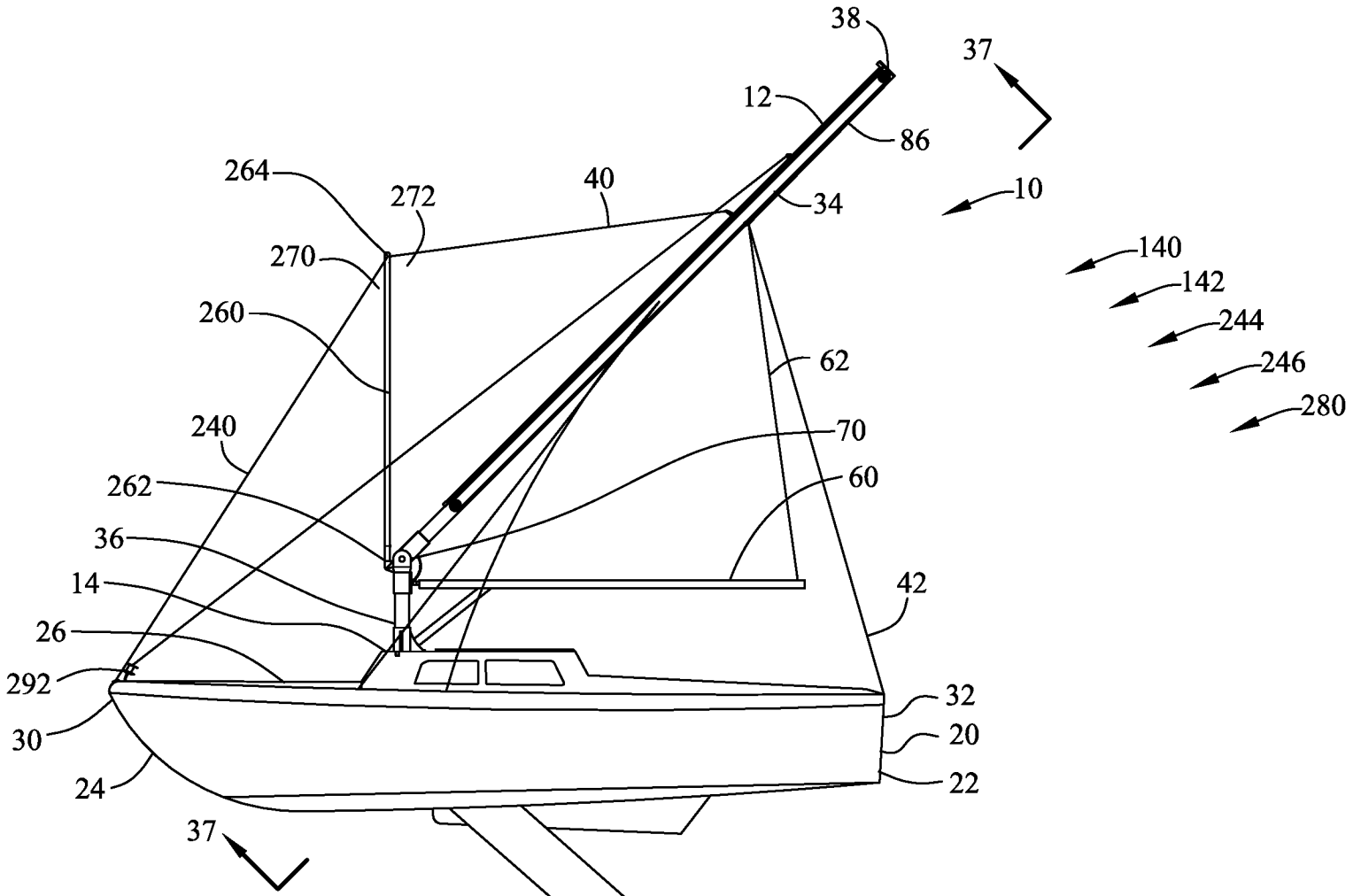
FIG. 5 is a view similar to FIG. 4 illustrating the mast having a further partially lowering displacement from a vertical position.
Figure 55:
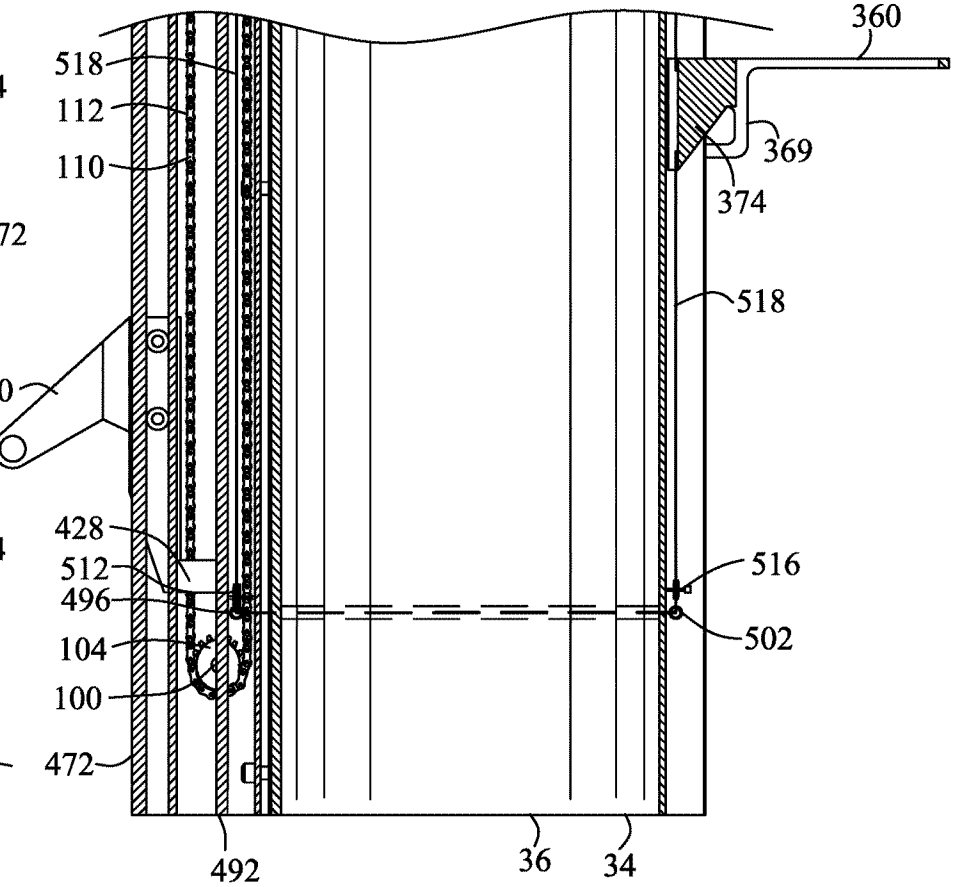
FIG. 55 is an enlarged view of the lower portion of FIG. 53 illustrating the tether traversing the lower exterior conduit housing.
Figure 54:
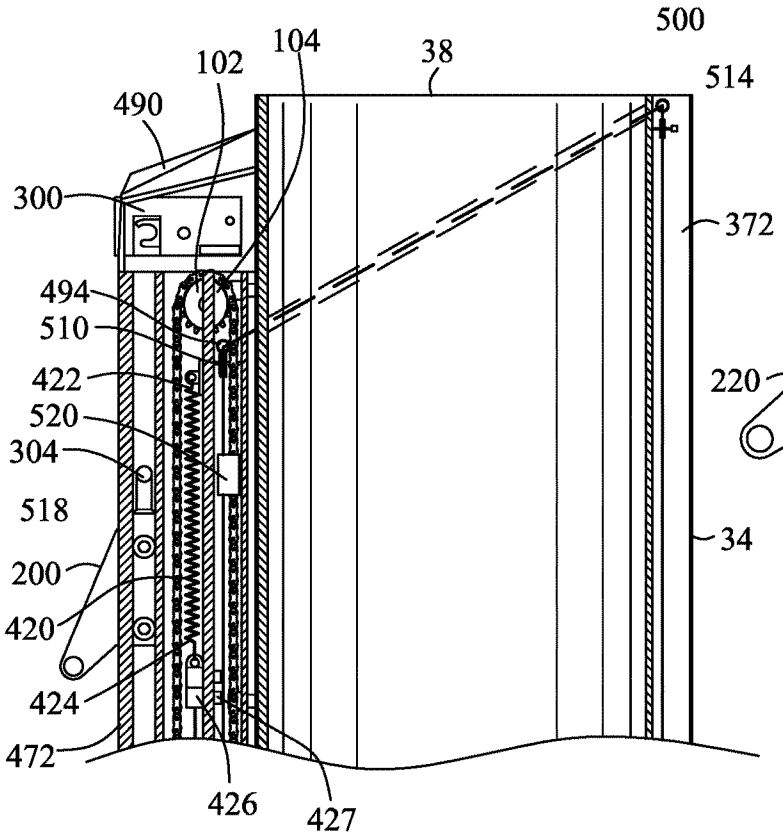
FIG. 54 is an enlarged view of the upper portion of FIG. 53 illustrating the tether traversing the upper exterior conduit housing.

FIGS. 1-55 illustrate a pivoting mast device 10 for pivoting an elongated body 12 relative to a surface 14. The pivoting mast device 10 may be utilized on a vessel 20, however, the pivoting mast device 10 may also be utilized on any stationary or moveable object.

The vessel 20 may include a sailing vessel 22 having a hull 24 and deck 26. The hull 24 extends from a bow 30 to a stern 32. The deck 26 may support a mast 34 extending between a proximal end 36 and a distal end 38. The mast 34 may be maintained in a vertical position by a headstay 40, a backstay 42, an outer starboard sidestay 44, a front lower starboard sidestay 46, a rear lower starboard sidestay 48, an outer port sidestay 50, a front lower port sidestay 52, a rear lower port sidestay 54 extending from the mast 34 to the deck 26. A boom 60 is pivotably coupled to the mast 34. A topping lift 62 is secured between the boom 60 and the distal end 38. The topping lift 62 supports the boom 60 in a general horizontal position.

The pivoting vessel mast device 10 comprises a mast coupler 70 bisecting the mast 34 approximate to the proximal end 36 into a lower mast portion 72 and an upper mast portion 74. The mast coupler 70 includes a mast pivot 76 pivotably coupling an upper mast socket 80 and a lower mast socket 82. The lower mast portion 72 is inserted into the lower mast socket 82 and the upper mast portion 74 is inserted into the upper mast socket 80. The mast coupler 70 may be secured to the lower mast portion 72 and the upper mast portion 74 by welding, bolts or other fastening means. The mast coupler 70 pivots the upper mast portion 80 between a vertical position 84 and a non-vertical position 86. The non-vertical position 86 may include a horizontal position 88 but may alternatively be any non-vertical orientation.

A lower wheel 100 is rotatably coupled approximate to and above the mast coupler 70 on the upper mast portion 74. An upper wheel 102 is rotatably coupled approximate to the distal end 38 of the upper mast portion 74. As shown in FIGS. 12-22 and 31-35, the lower wheel 100 and the upper wheel 102 may include a sprocket 104. Alternatively, as shown in FIGS. 23-27 the lower wheel 100 and the upper wheel 102 include a threaded sleeve 106.

A linkage 110 couples the lower wheel 100 to the upper wheel 102. As shown in FIGS. 12-22 and 31-35, the linkage 110 may include a chain 112 encircling both the sprockets 104 and defining a first vertical chain member 114 and a second vertical chain member 116. Alternatively, as shown in FIGS. 23-27 the linkage 110 may include a threaded rod 118 threadably engaging the threaded sleeves 106.

Figure 12:
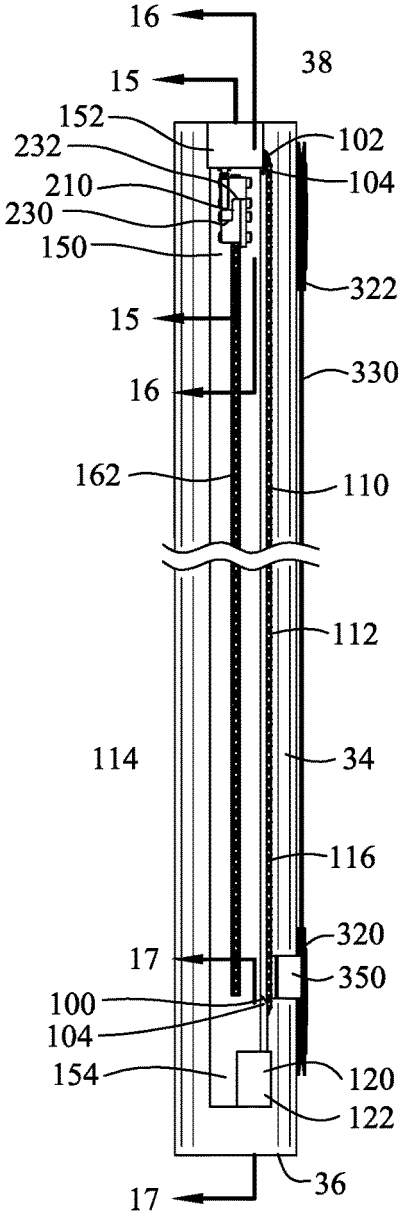
FIG. 12 is a broken front view of a first embodiment of a pivoting mast device of FIGS. 1-11.
Figure 13:
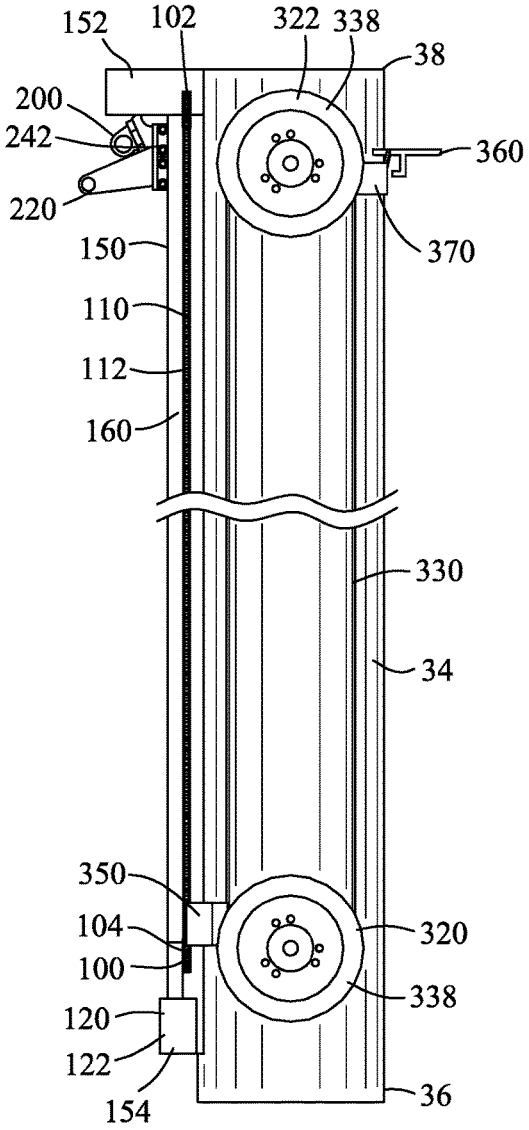
FIG. 13 is a broken right side view of FIG. 12.
Figure 15:
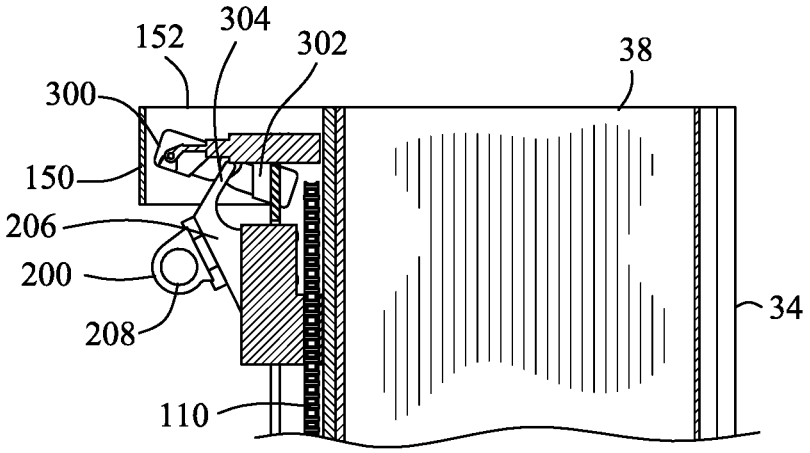
FIG. 15 is a sectional view along line 15-15 in FIG. 12.
Figure 16:
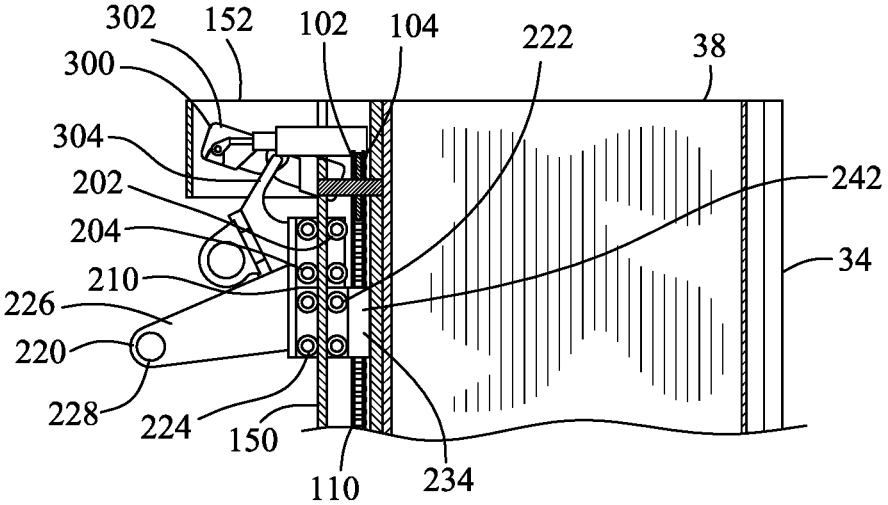
FIG. 16 is a sectional view along line 16-16 in FIG. 12.
Figure 17:
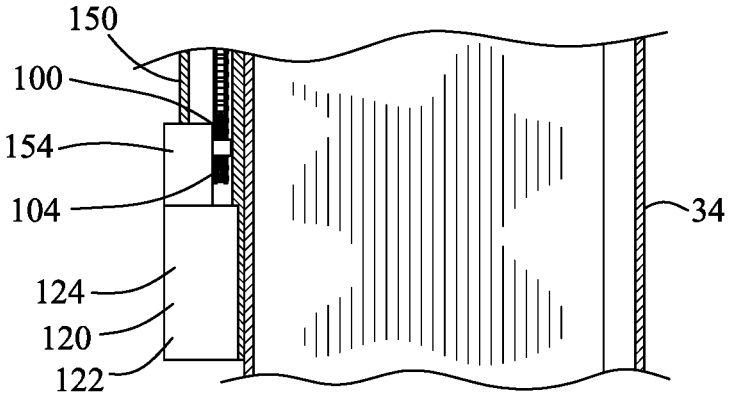
FIG. 17 is a sectional view along line 17-17 in FIG. 12.
Figure 20:
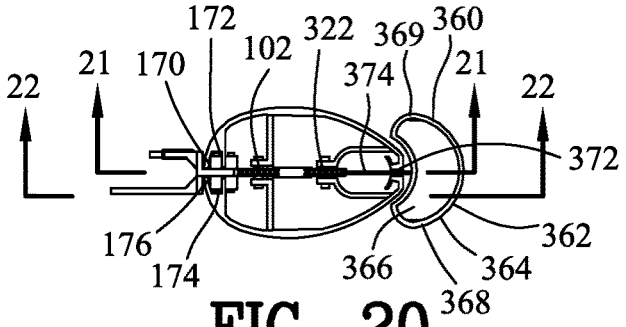
FIG. 20 is a top view of FIG. 19.
Figure 18:
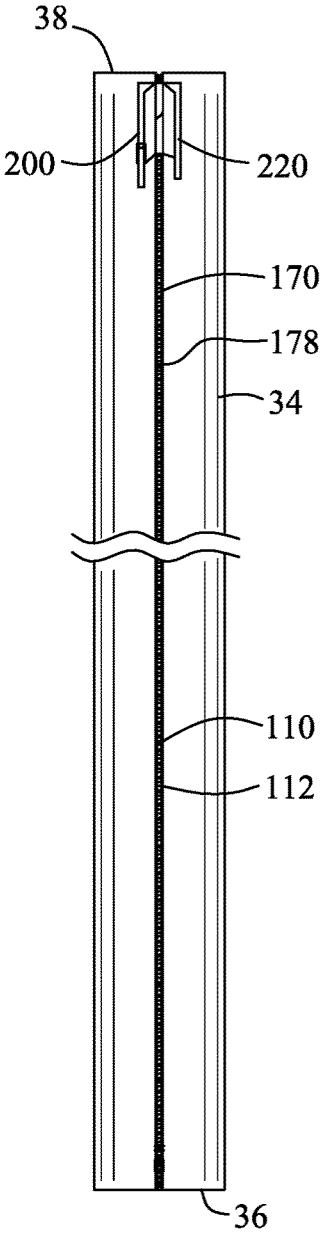
FIG. 18 is a broken front view of a second embodiment of a pivoting mast device of FIGS. 1-11.
Figure 19:
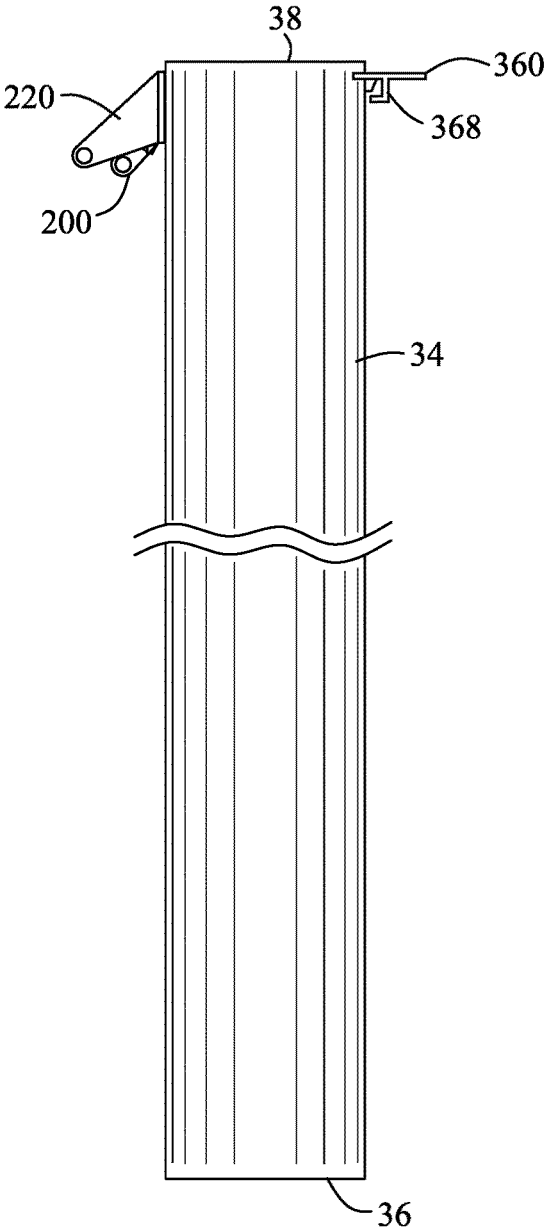
FIG. 19 is a broken right side view of FIG. 18.
Figure 21:
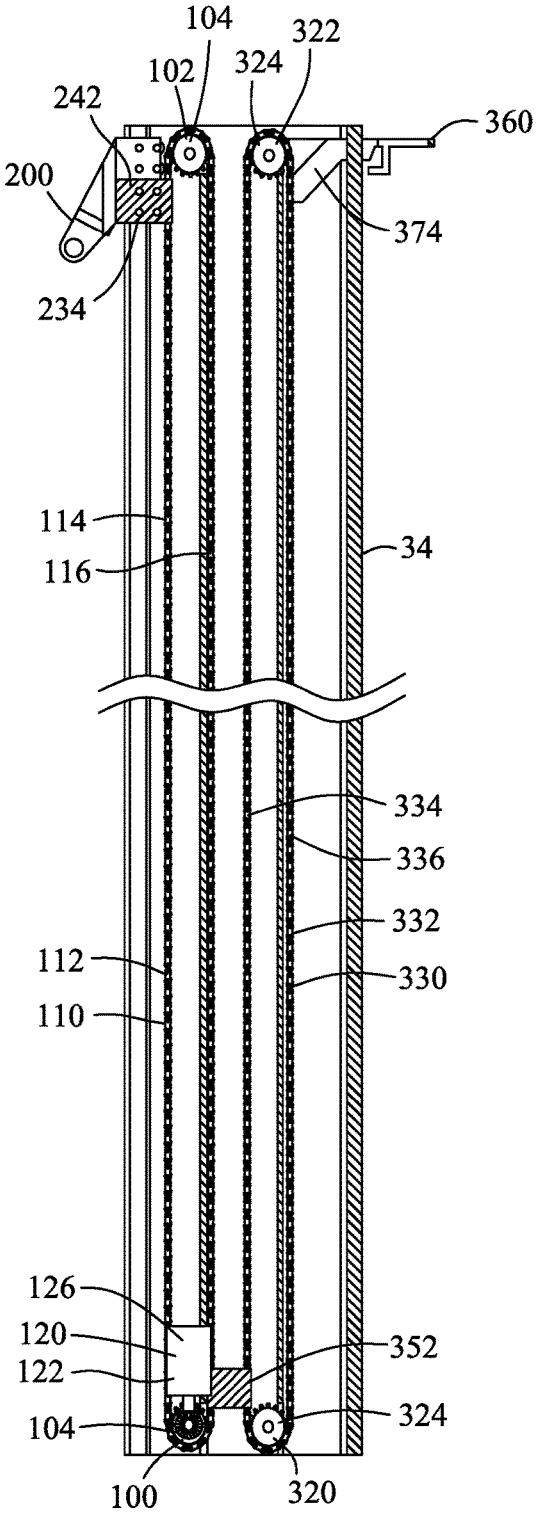
FIG. 21 is a sectional view along line 21-21 in FIG. 20.
Figure 22:
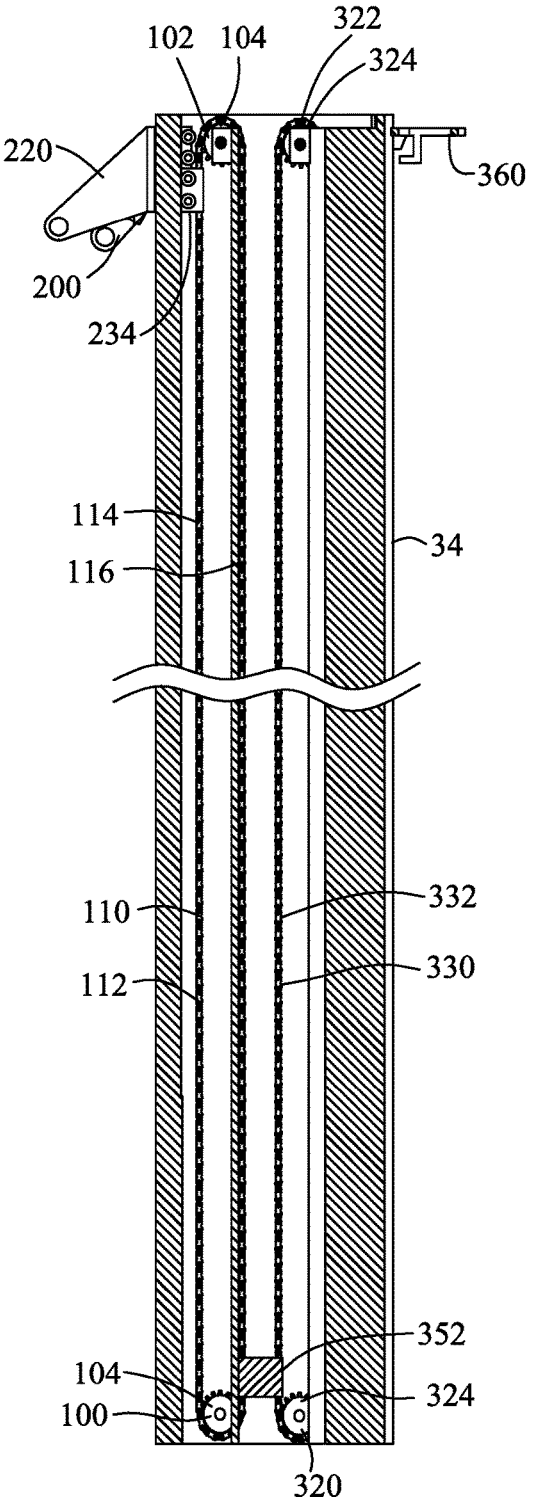
FIG. 22 is a sectional view along line 22-22 in FIG. 20.
Figure 25:
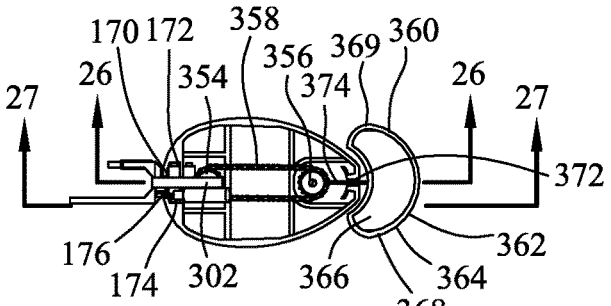
FIG. 25 is a top view of FIG. 24.
Figure 23:
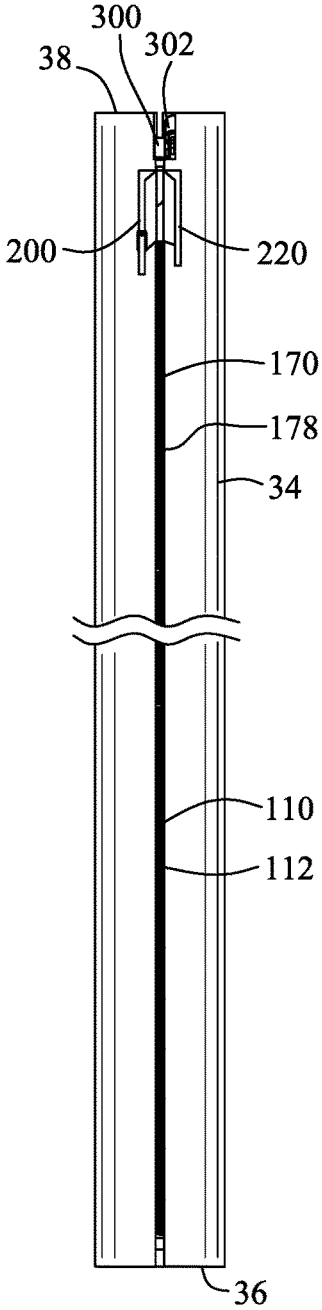
FIG. 23 is a broken front view of a third embodiment of a pivoting mast device of FIGS. 1-11.
Figure 24:
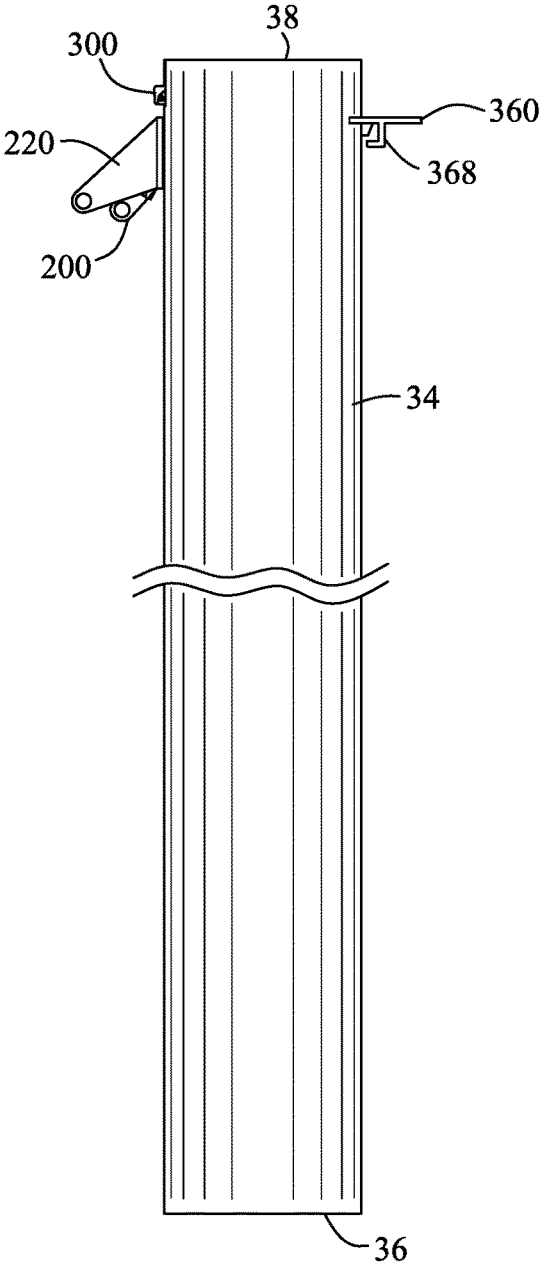
FIG. 24 is a broken right side view of FIG. 23.
Figure 26:
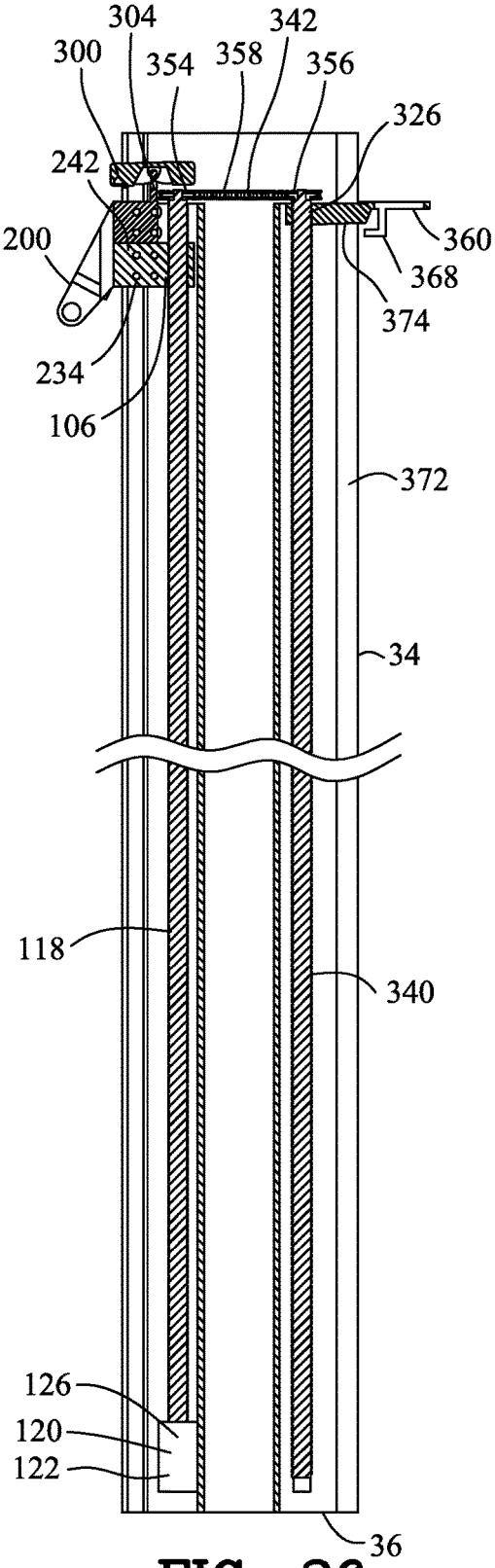
FIG. 26 is a sectional view along line 26-26 in FIG. 25.
Figure 27:
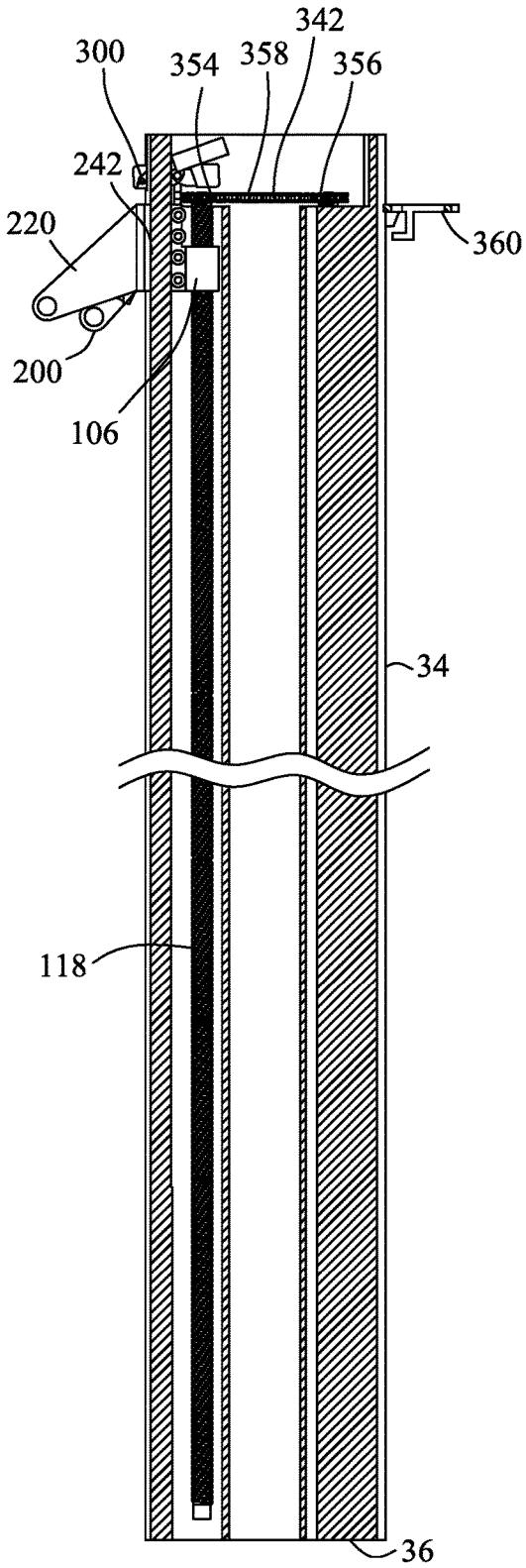
FIG. 27 is a sectional view along line 27-27 in FIG. 25.
Figure 30:
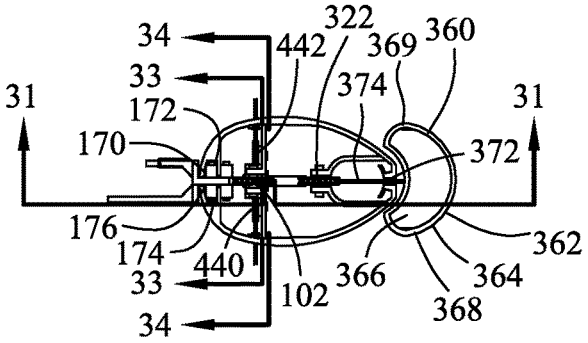
FIG. 30 is a top view of FIG. 29.
Figure 28:
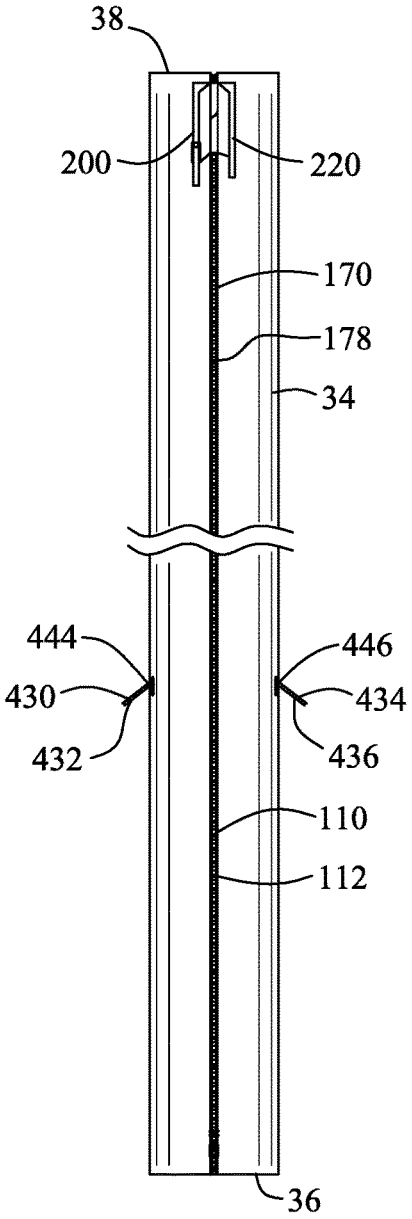
FIG. 28 is a broken front view of a fourth embodiment of a pivoting mast device of FIGS. 1-11.
Figure 29:
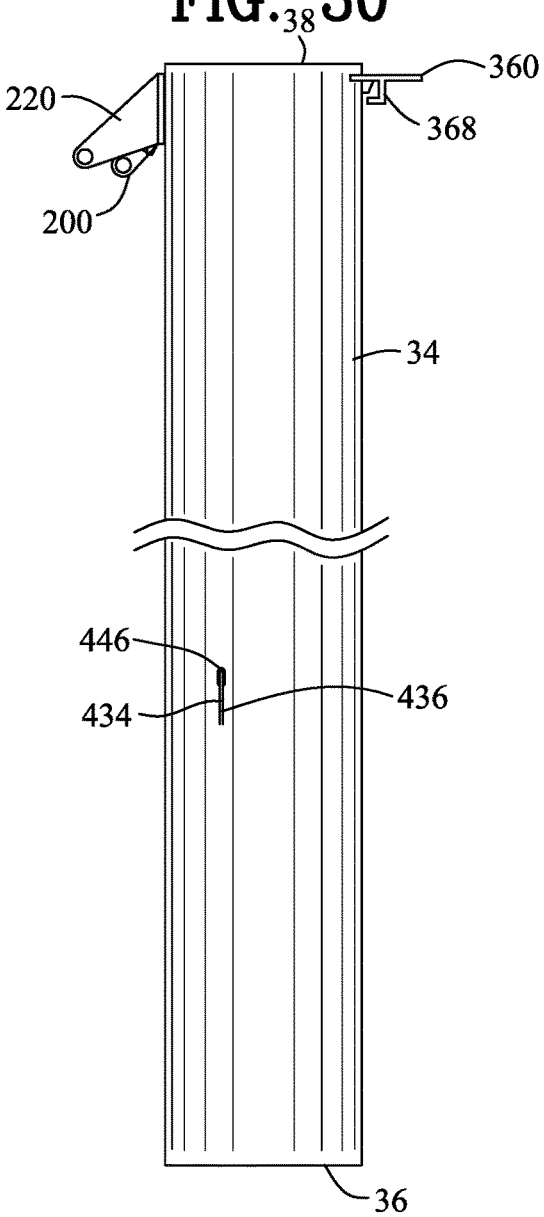
FIG. 29 is a broken right side view of FIG. 28.
Figure 31:
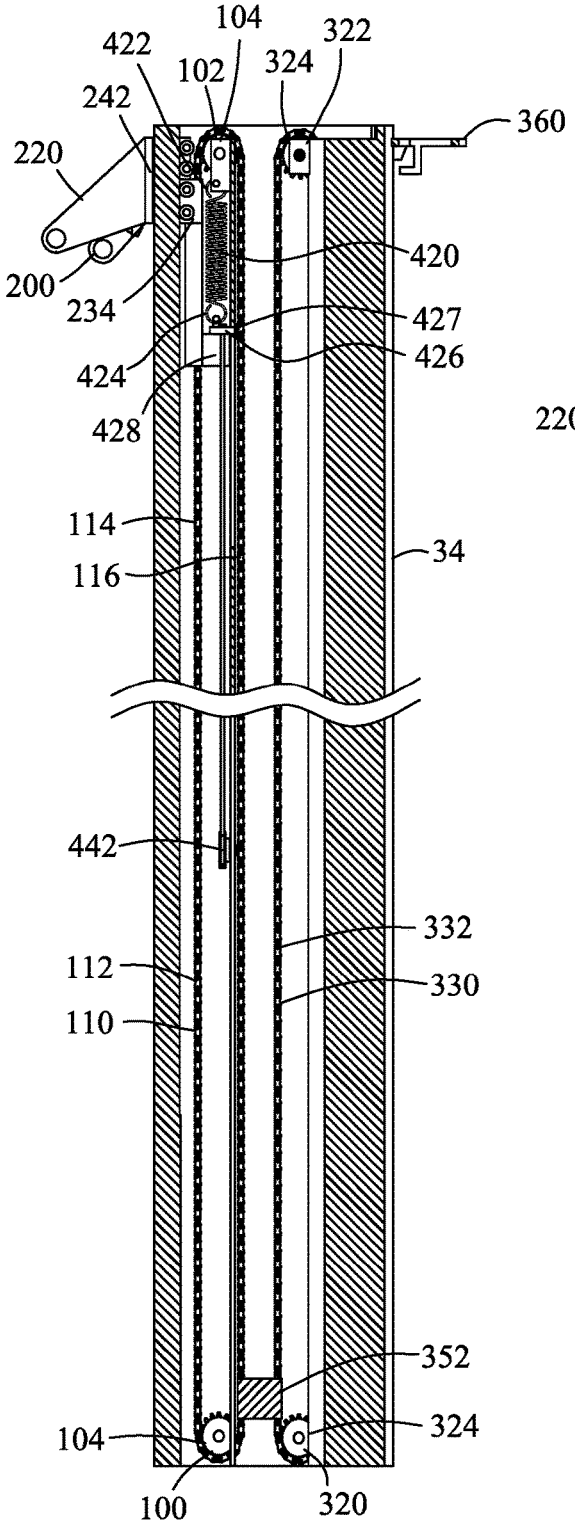
FIG. 31 is a sectional view along line 31-31 in FIG. 30.
Figure 32:
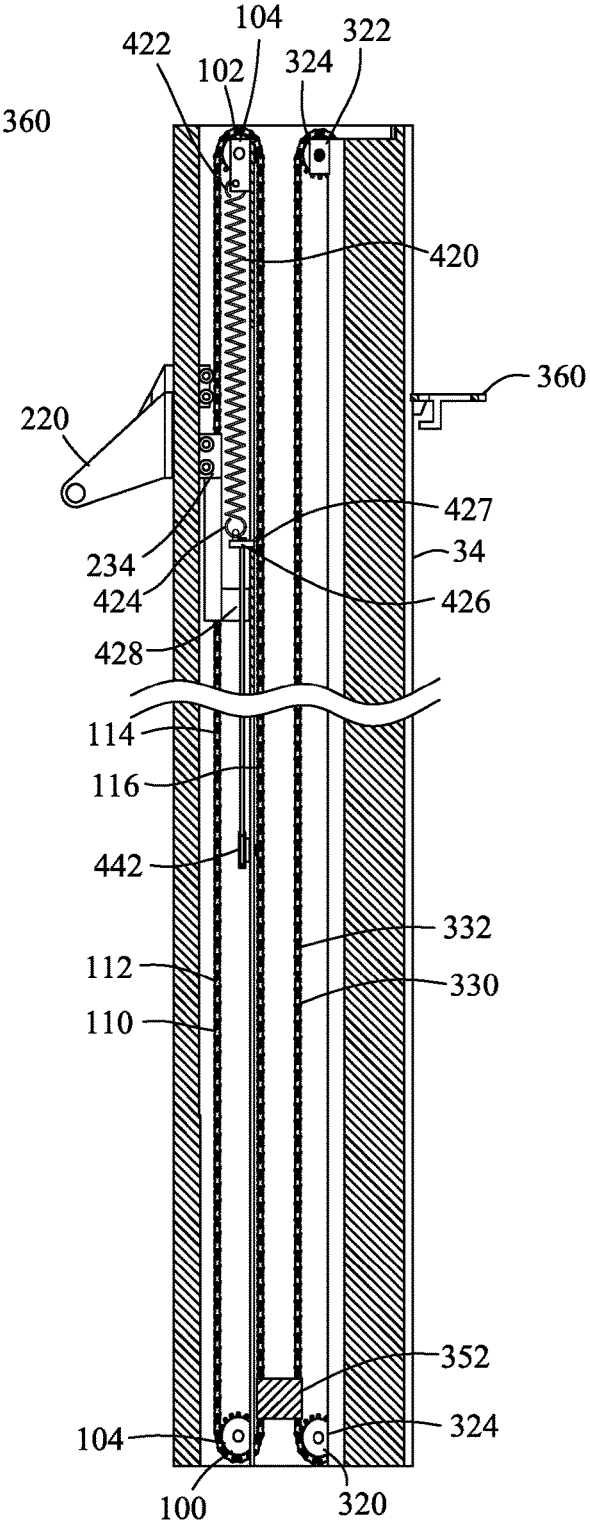
FIG. 32 is a view similar to FIG. 31, illustrating a stay spring expanding after a mast lowering displacement.
Figure 33:
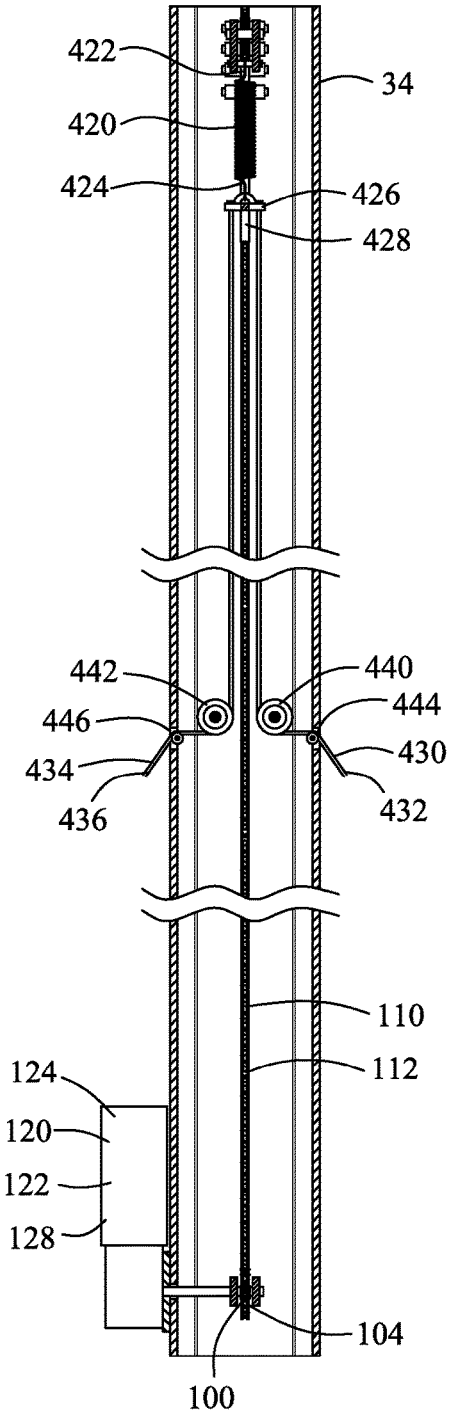
FIG. 33 is a sectional view along line 33-33 in FIG. 30.
Figure 34:
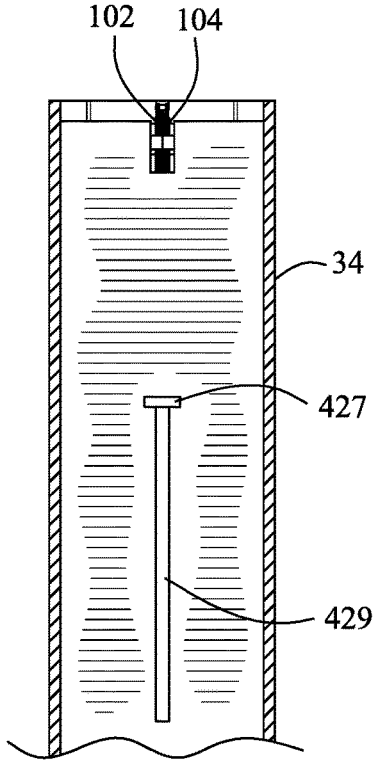
FIG. 34 is a sectional view along line 34-34 in FIG. 30.
Figure 35:
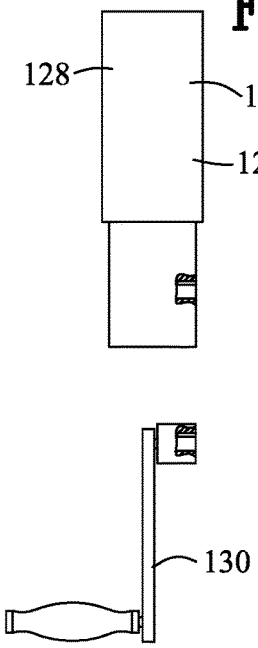
FIG. 35 is an exploded view of a portion of FIG. 33, illustrating either a motor or a wench handle engaging a driving shaft.
Figure 35:
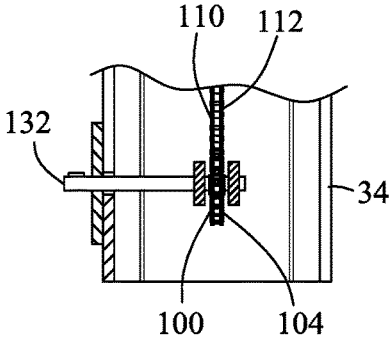
Figure 36:
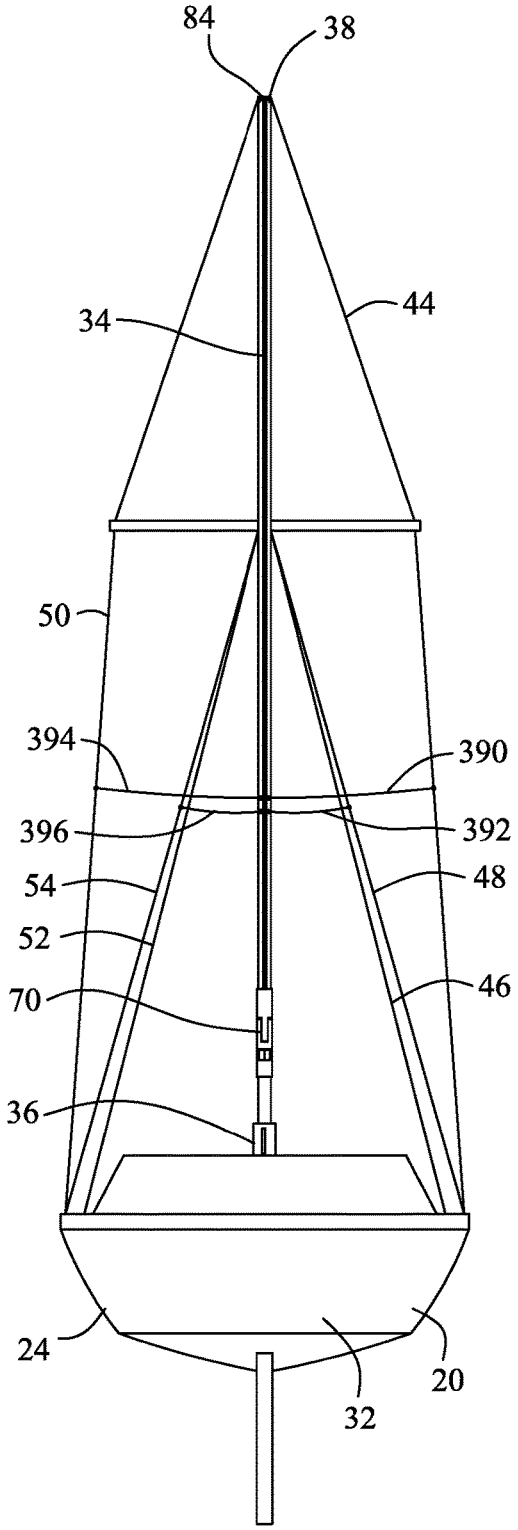
FIG. 36 is a view along line 36-36 in FIG. 1.
Figure 37:
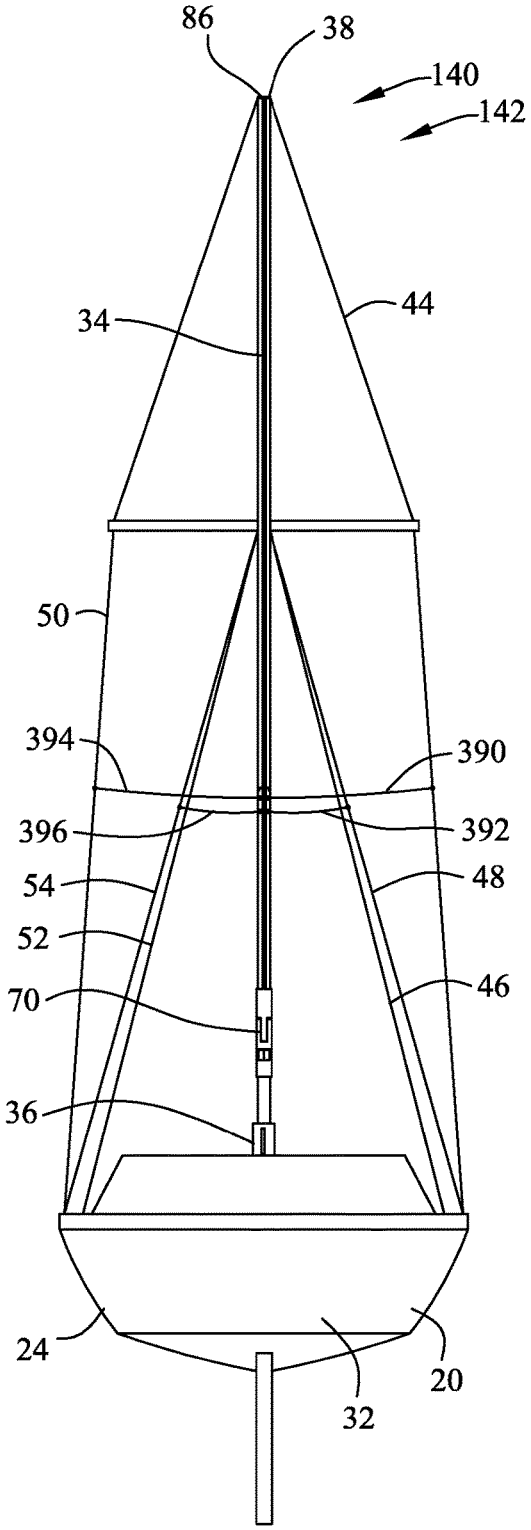
FIG. 37 is a view along line 37-37 in FIG. 5.
Figure 38:
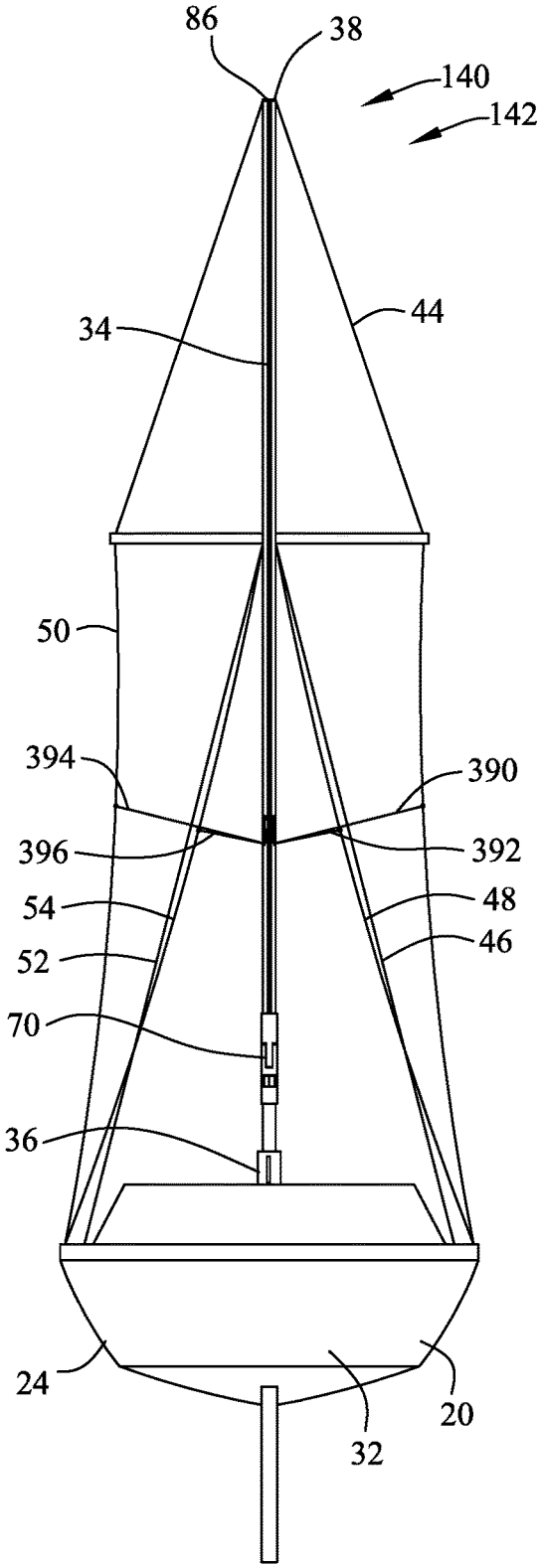
FIG. 38 is a view along line 38-38 in FIG. 8.
Figure 39:
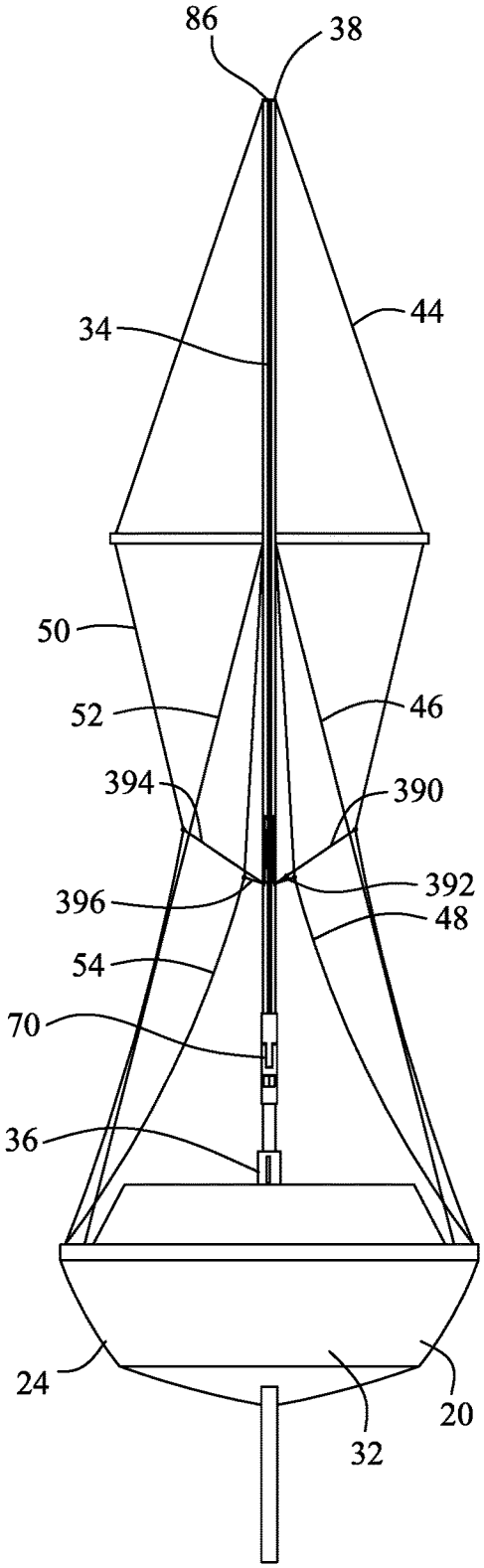
FIG. 39 is a view along line 39-39 in FIG. 9.
Figure 42:
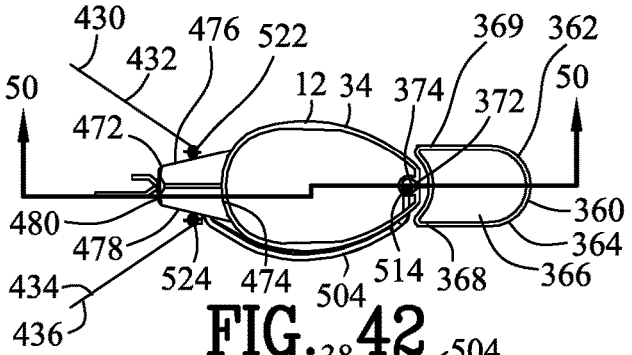
FIG. 42 is a top view of FIG. 41.
Figure 40:
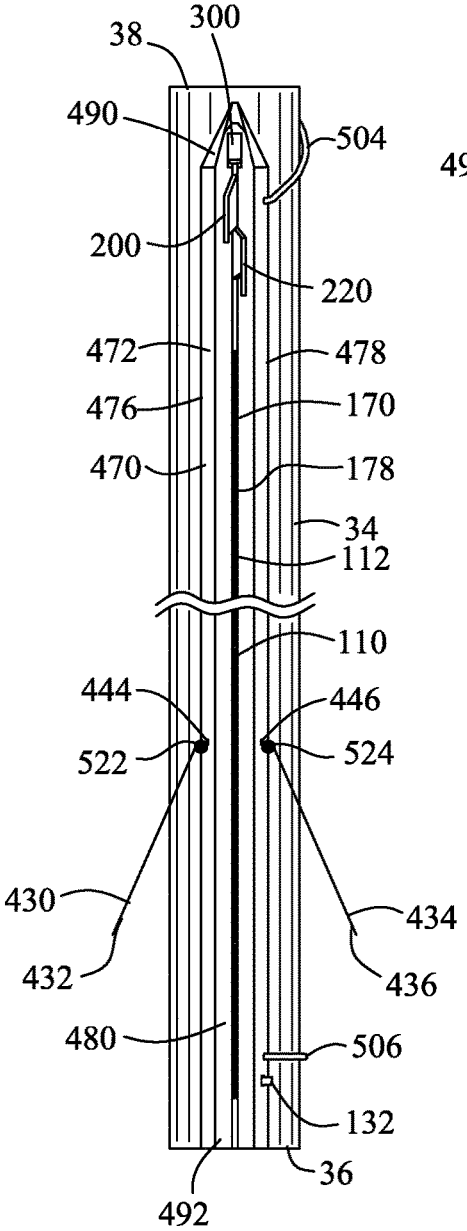
FIG. 40 is a broken front view of a fifth embodiment of a pivoting mast device of FIGS. 40-55.
Figure 41:
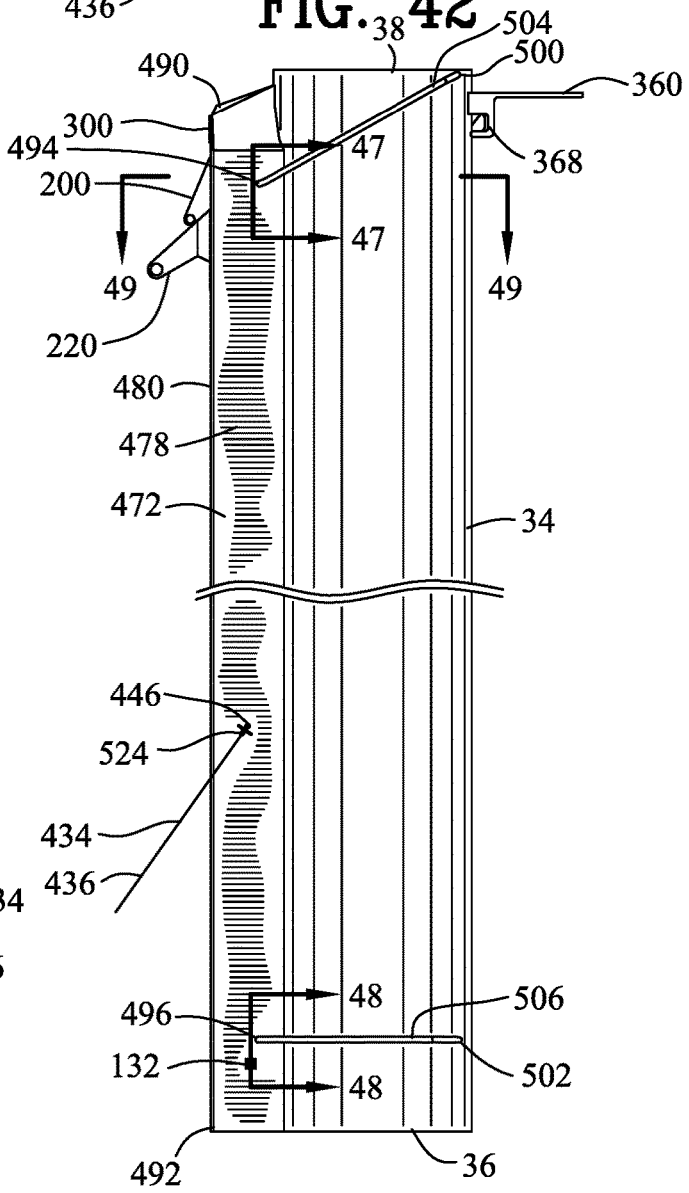
FIG. 41 is a broken right side view of FIG. 40.
Figure 44:
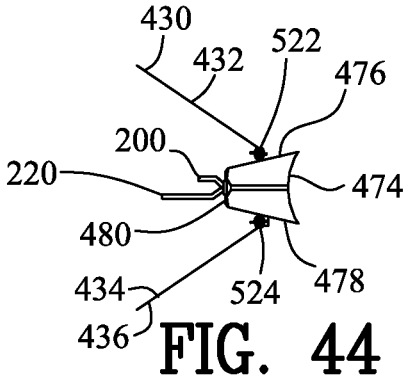
FIG. 44 is a top view of FIG. 43.
Figure 46:
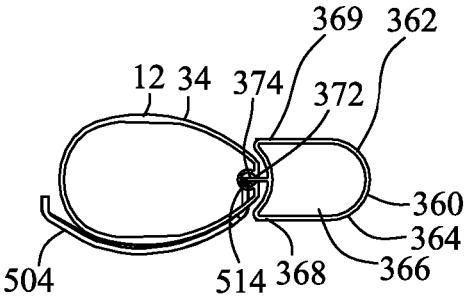
FIG. 46 is a top view of FIG. 45.
Figure 43:
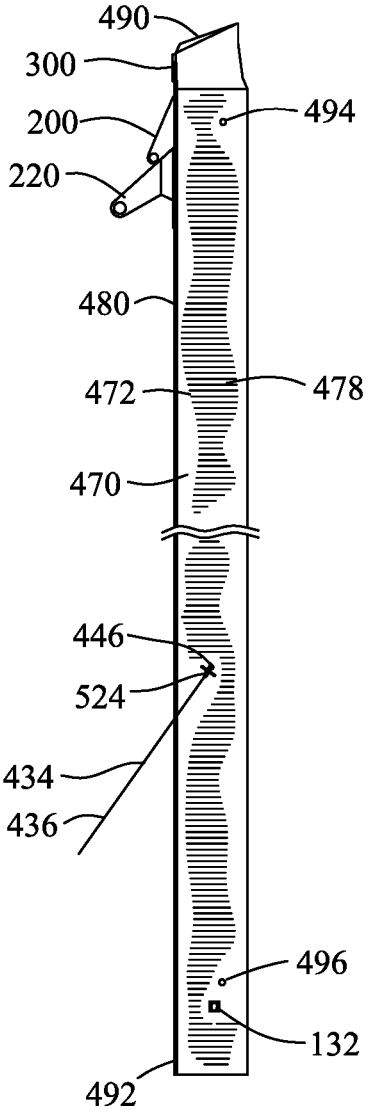
FIG. 43 is a broken right side view of the exterior housing in FIG. 41.
Figure 45:
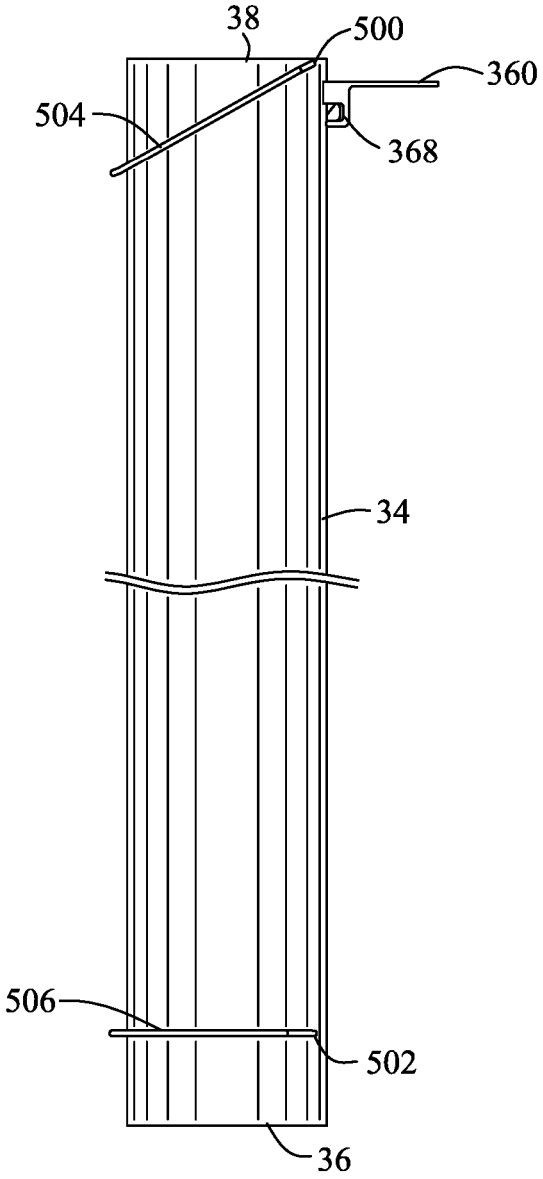
FIG. 45 is a broken right side view of the mast in FIG. 41.
Figure 49:
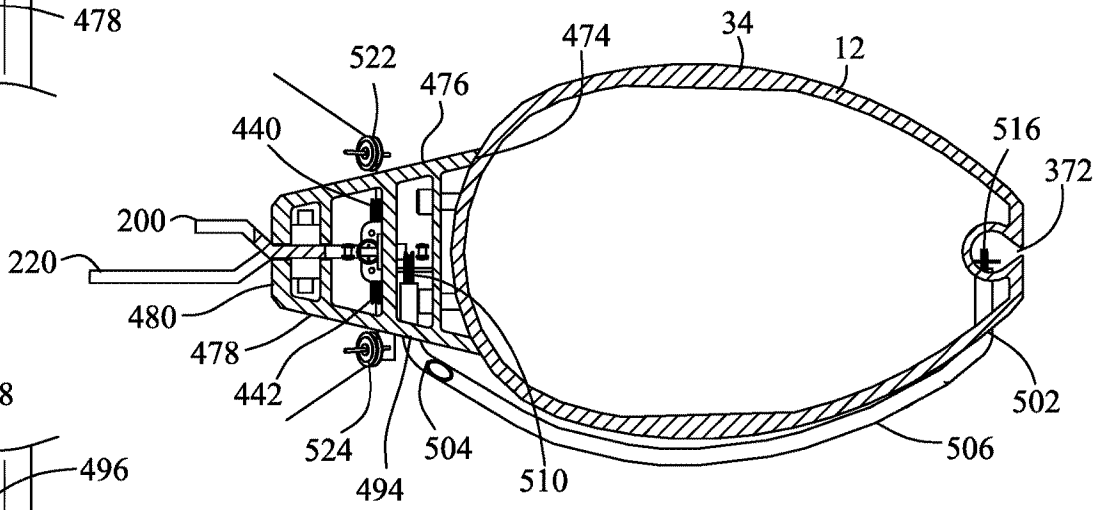
FIG. 49 is a sectional view along line 49-49 in FIG. 41.
Figure 47:
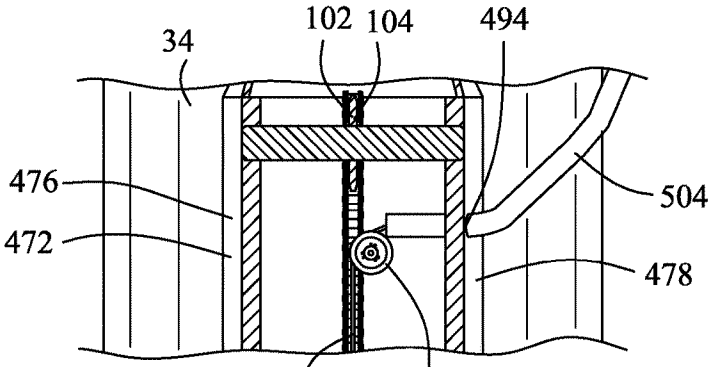
FIG. 47 is a sectional view along line 47-47 in FIG. 41.
Figure 48:
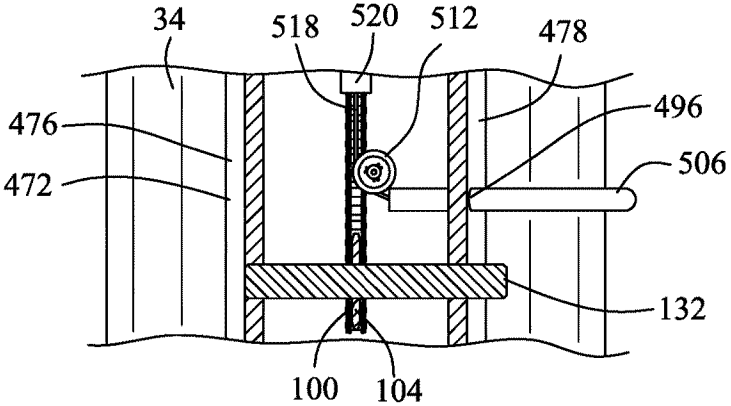
FIG. 48 is a sectional view along line 48-48 in FIG. 41.
Figure 50:
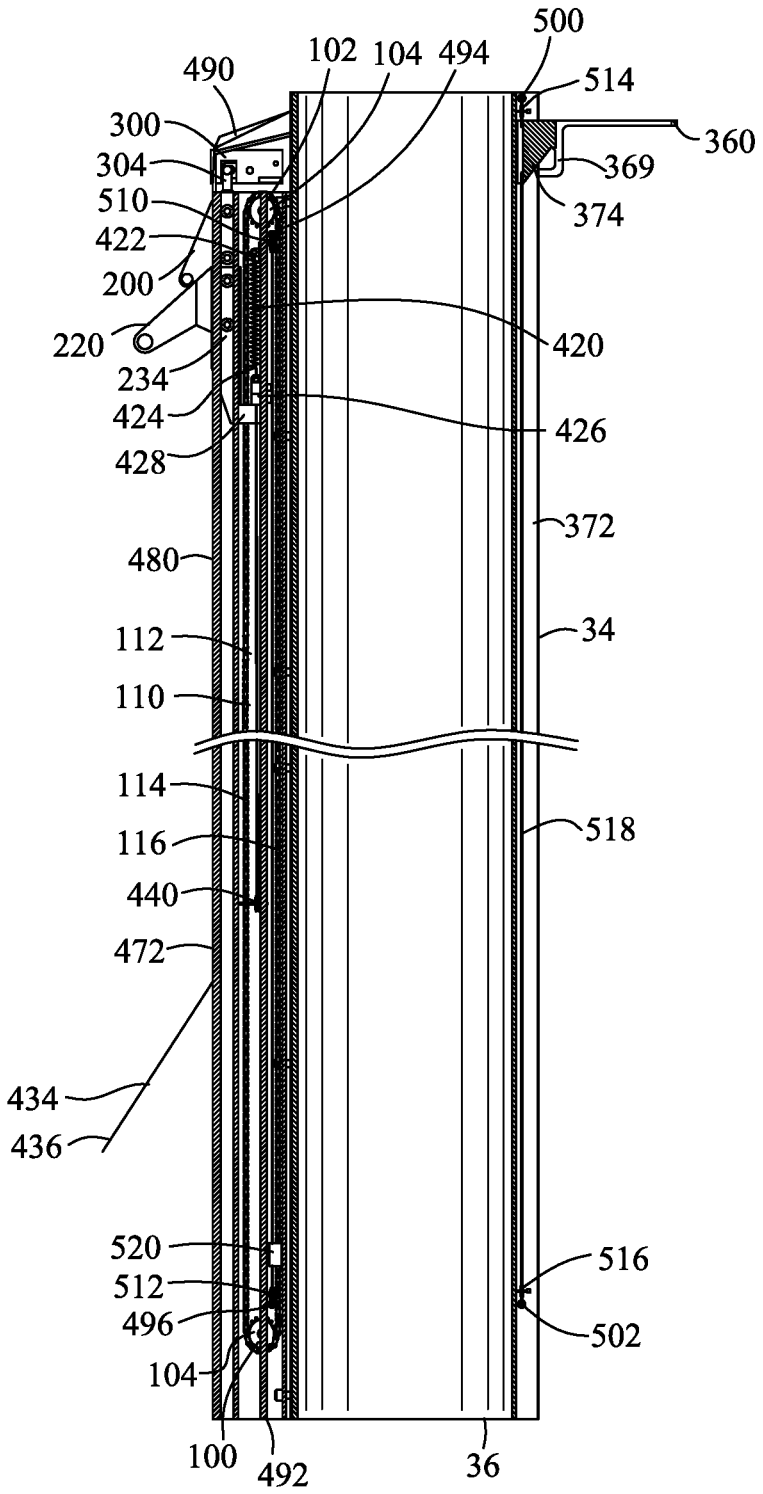
FIG. 50 is a sectional view along line 47-47 in FIG. 42.
Figure 52:
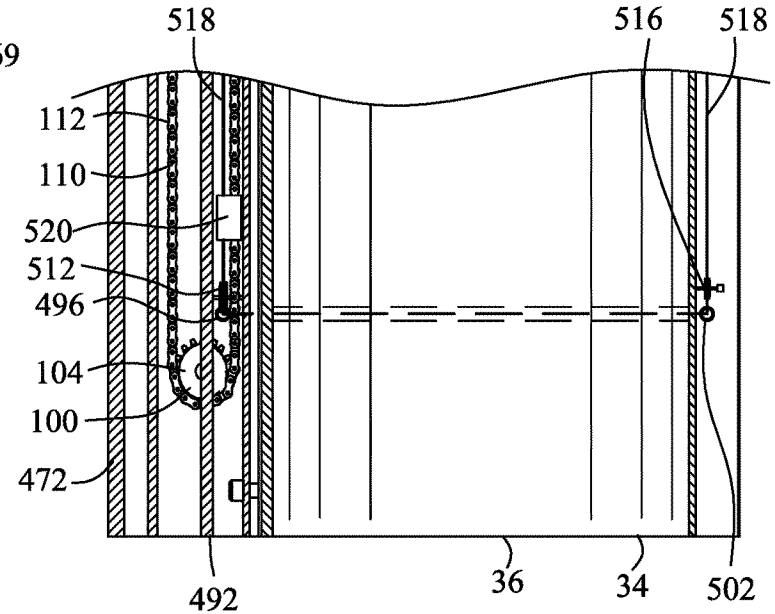
FIG. 52 is an enlarged view of a lower portion of FIG. 50 illustrating the tether traversing a lower exterior conduit housing.
Figure 51:
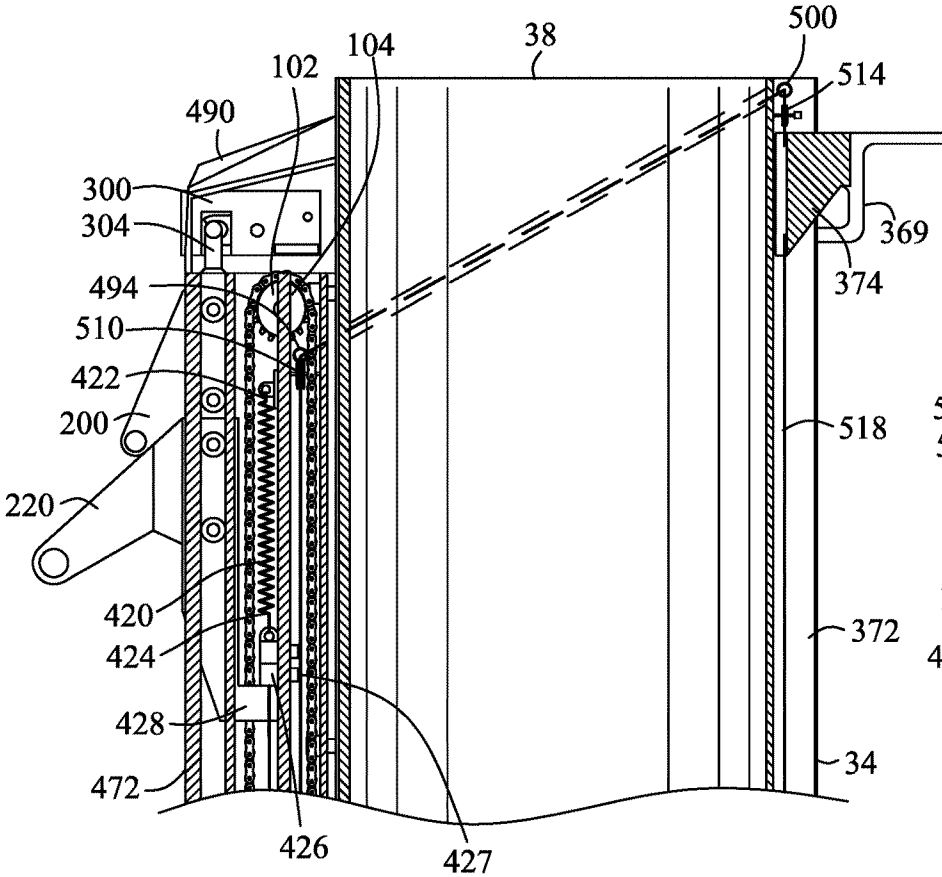
FIG. 51 is an enlarged view of an upper portion of FIG. 50 illustrating a tether traversing an upper exterior conduit housing.
Figure 53:
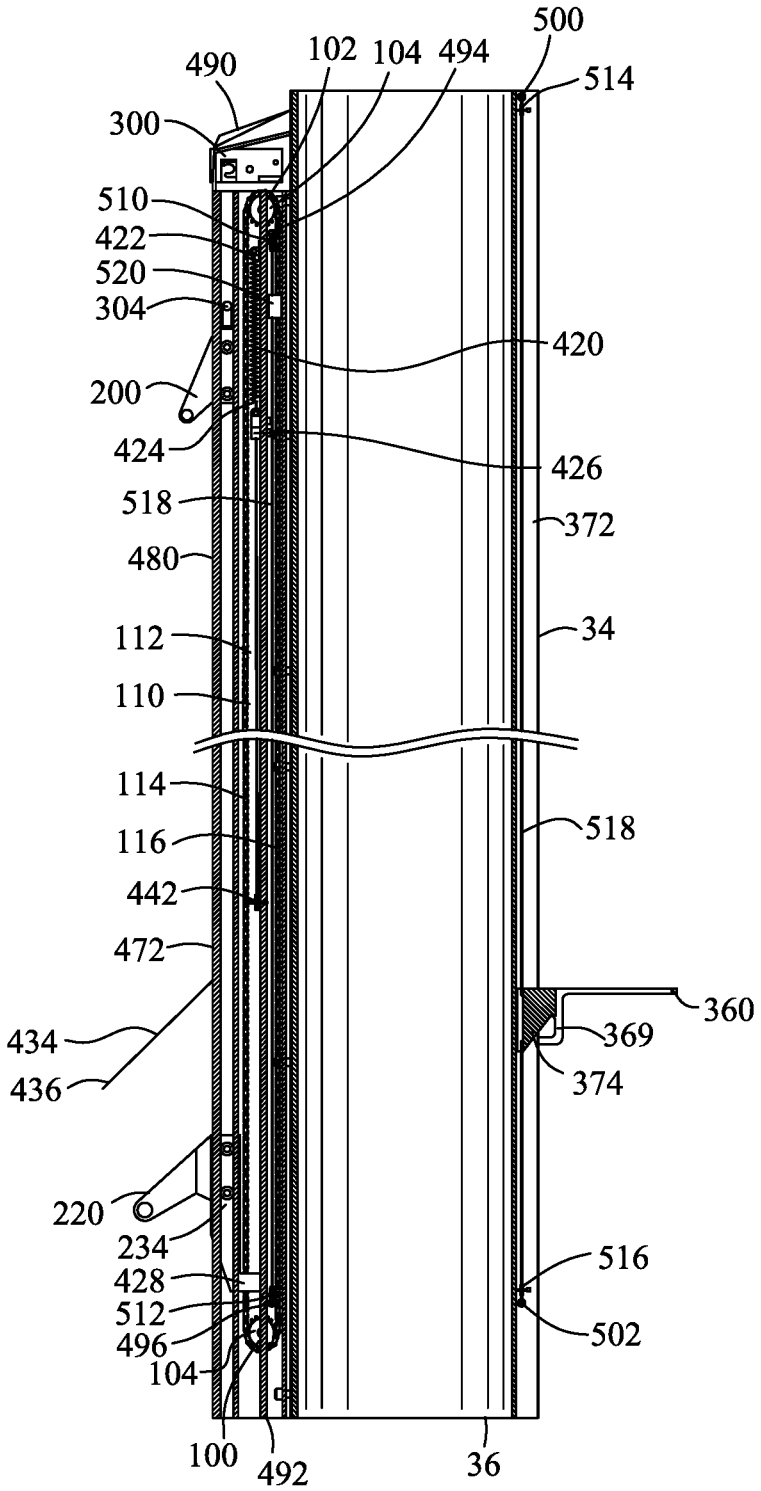
FIG. 53 is a view similar to FIG. 50 illustrating the mast lowering displacement.

A drive 120 is coupled to the lower wheel 100 for displacing the linkage 110 in a descending direction 130 or an ascending direction 132 relative to the upper mast portion 72. The drive 120 may include an electric motor 122. The motor 122 may include an exteriorly mount 124 as shown in FIGS. 12 and 13 for positioning the motor 122 to the exterior of the mast 34. Alternatively, the motor 122 may include an interior mount 126 as shown in FIG. 26 for positioning the motor 122 to the interior of the mast 34. In addition, the motor 122 may include any removable mount 128 as shown in FIGS. 33 and 35 for removably coupling the motor 122 to the exterior of the mast 34. The drive 120 may further include a wench handle 130. As shown in FIG. 35, either the drive 120 or the wench handle 130 may be utilized for displacing the linkage 110. More specifically, a driveshaft 132 is coupled to the lower wheel 100 and extends to the exterior of the mast 34. The driveshaft 132 includes a keyed end 134 that may alternatively engage the motor 122 or the wench handle 130. The wench handle 130 may be utilized as a backup for replacement of the motor 122 if the motor shall fail. The motor 122 may be removably secured to the mast 34 by a keyed channel and keyed arm lock coupling, fasteners or other removable devices.

FIGS. 7, 12-17 illustrate an exterior track 150 coupled to the exterior and in front of the mast 34. The exterior track 150 extends from approximate to and above the mast coupler 70 and to the distal end 38 of the mast 34. The exterior track 150 may be coupled to an existing mast 34 wherein the vessel was not originally constructed with the pivoting mast device 10. The exterior track 150 may be fastened to the mast 34 by welding bolting or other fasteners. The exterior track 150 includes an upper track housing 152 adjacent to the distal end 38 of the mast 34, a lower track housing 154 adjacent to the proximal end 36. Furthermore, the exterior track 150 includes a primary J-shaped track 156 and a secondary J-shaped track 158. The primary J-shaped track 156 and a secondary J-shaped track 158 defining a track cavity 160 and track groove 162 therebetween.

FIGS. 7, 12-17 illustrate an upper traveler 200 and a lower traveler 220 slidably engaging the exterior track 150. A plurality of interior upper wheels 202 and a plurality of exterior upper wheels 204 are mounted to an upper base frame 206. The plurality of interior upper wheels 202 and the plurality of exterior upper wheels 204 are rotatably coupled to the upper base frame 206 of the upper traveler 200 for engaging the exterior track 150. More specifically, the plurality of interior upper wheels 202 are positioned within the track cavity 180 and the plurality of exterior upper wheels 204 are positioned to the exterior of the primary J-shaped track 176 and a secondary J-shaped track 178. The upper base frame 206 traverses the track groove 182 and extends beyond the exterior track 150. The upper base frame 206 includes an upper headstay aperture 208 for receiving the headstay 40. The upper base frame 206 further includes a stepped upper surface 210.

A plurality of interior lower wheels 222 and a plurality of exterior lower wheels 224 are mounted to a lower base frame 226. The plurality of interior lower wheels 222 and the plurality of exterior lower wheels 224 are rotatably coupled to the lower base frame 226 of the lower traveler 220 for engaging the exterior track 150. More specifically, the plurality of interior lower wheels 222 are positioned within the track cavity 180 and the plurality of exterior lower wheels 224 are positioned to the exterior of the primary J-shaped track 176 and a secondary J-shaped track 178. The lower base frame 226 traverses the track groove 182 and extends beyond the exterior track 150. The lower base frame 226 includes a lowering stay aperture 228. The lower base frame 226 further includes a stepped lower surface 230.

The lower traveler 160 is coupled to the linkage 110 by a lower frame arm 234. The lower frame arm 234 translates any ascending displacement or descending displacement of the linkage 110 to the lower traveler 160. The stepped upper surface 210 and the stepped lower surface 230 have a continuous contact surface 232 for translating an ascending displacement of the lower traveler 220 into the upper traveler 200 upon the stepped lower surface 230 engaging with the stepped upper surface 210.

FIGS. 18-35 illustrate an interior track 170 coupled to the interior of the mast 34. The interior track 170 extends approximate to and above the mast coupler 70 and the proximate end 36 of the mast 34. The interior track 170 may be installed to a newly manufactured mast 34 wherein the vessel was originally constructed with the pivoting mast device 10. The interior track 170 includes a primary C-shaped track 172 and a secondary C-shaped track 174. Each of said primary C-shaped track 172 and a secondary C-shaped track 174 define a track cavity 176 and track groove 178 therebetween.

Similar to FIGS. 7, 12-17, the mast 34 in FIGS. 18-35 illustrate the upper traveler 200 and the lower traveler 220 slidably engaging the interior track 170. The plurality of interior upper wheels 202 and the plurality of exterior upper wheels 204 are mounted to the upper base frame 206. The plurality of interior upper wheels 202 and the plurality of exterior upper wheels 204 are rotatably coupled to the upper base frame 206 of the upper traveler 200 for engaging the interior track 170. More specifically, the plurality of interior upper wheels 202 are positioned outside of the primary C-shaped track 172 and the secondary C-shaped track 174 and the plurality of exterior upper wheels 204 are positioned within the track cavity 176 of the primary C-shaped track 172 and the secondary C-shaped track 174. The upper base frame 206 traverses the track groove 178 and extends beyond the exterior of the mast 34. The upper base frame 206 includes an upper headstay aperture 208 for receiving the headstay 40. The upper base frame 206 further includes a stepped upper surface 210.

The plurality of interior lower wheels 222 and the plurality of exterior lower wheels 224 are rotatably coupled to the lower base frame 226 of the lower traveler 220 for engaging the interior track 170. More specifically, the plurality of interior lower wheels 222 are positioned outside of the primary C-shaped track 172 and the secondary C-shaped track 174 and the plurality of exterior lower wheels 224 are positioned within the track cavity 176 of the primary C-shaped track 172 and the secondary C-shaped track 174. The lower base frame 226 traverses the track groove 178 and extends beyond the exterior of the mast 34. The upper base frame 206 includes an upper headstay aperture 208 for receiving the headstay 40. The upper base frame 206 further includes a stepped upper surface 210. The lower base frame 226 includes a lowering stay aperture 228. The lower base frame 226 further includes a stepped lower surface 230.

The lower traveler 220 is coupled to the linkage 110 by a lower frame arm 234. The lower frame arm 234 translates any ascending displacement or descending displacement of the linkage 110 to the lower traveler 160. The stepped upper surface 210 and the stepped lower surface 230 have a continuous contact surface 232 for translating an ascending displacement of the lower traveler 220 into the upper traveler 200 upon the stepped lower surface 230 engaging with the stepped upper surface 210.

As shown in FIGS. 1-10, a lowering stay 240 is secured to the bow 30 and the lowering traveled 220. FIGS. 1, 15, 16, 21, 22, 26, 27, 31, 33 and 36 illustrate a vertical mast lock 242 defined by the stepped lower surface 230 of the lower traveler 220 abutting the stepped upper surface 210 of the upper traveler 200 during the upper traveler 200 approximate to the distal end 38 of the upper mast portion 74. The vertical mast lock 242 maintains the mast 34 in a vertical orientation wherein the headstay 40, backstay 42, outer starboard sidestay 44, front lower starboard sidestay 46, rear lower starboard sidestay 48, outer port sidestay 50, front lower port sidestay 52, rear lower port sidestay 54, and the lowering stay 240 are in tension.

As shown in FIGS. 4-8 and 37-39 the drive 120 is activated for displacing the linkage 110. Upon a descending displacement of the linkage 110 causes the lower traveler 220 to descend relative to the upper mast portion 72. Immediately upon the lower traveler 220 having a descending displacement, the upper traveler 200 due to gravity and the weight of the headstay 40 begins a descending displacement. As the lower traveler 220 continues a descending displacement, the upper mast portion 74 begins pivoting relative to the mast pivot 76. The lower traveler 220 continues a descending displacement until the upper mast portion 74 has been transitioned from a vertical position 84 to a non-vertical position 86. More specifically, a mast lowering displacement 244 is defined by the lower traveler 220 and the upper traveler 200 in the descending direction for pivoting the upper mast portion 80 from the vertical position 84 to the non-vertical position 86.

Alternatively, upon an ascending displacement of the linkage 110 causes the lower traveler 220 to ascend relative to the upper mast portion 72. Immediately upon the lower traveler 220 contacting the upper traveler 200, both the lower traveler 220 and the upper traveler 200 ascend together. As the lower traveler 220 has an ascending displacement, the upper mast portion 74 begins pivoting relative to the mast pivot 76. The lower traveler 220 continues an ascending displacement until the upper mast portion 74 has been transitioned from the non-vertical position 86 to the vertical position 84. More specifically, a mast raising displacement 246 is defined by the lower traveler 220 in the ascending direction for pivoting the upper mast portion 80 from the non-vertical position 86 to the vertical position 84.

During the mast lowering displacement 244 and the mast raising displacement 246, the outer starboard sidestay 44, front lower starboard sidestay 46, rear lower starboard sidestay 48, outer port sidestay 50, front lower port sidestay 52, rear lower port sidestay 54 are utilized for preventing any side to side displacement of the upper mast portion 74 relative to the hull 24. Furthermore, during the mast lowering displacement 244 and the mast raising displacement 246, the headstay may be distanced from the yoke mast 260 by an upper coil spring 290 and a lower coil spring 292 secured to the upper end of the headstay 40 and the lower end of the headstay 40 respectively. More specifically, the upper coil spring 290 and the lower coil spring 292 will displace the headstay 40 from alignment with the yoke mast 260 such that the headstay 40 does not engage with the yoke mast 260 and interfere with the mast lowering displacement 244 and the mast raising displacement 246. The sideways displacement of the headstay 40 from the yoke mast 260 is very imperative if the vessel 20 includes a roller furling headsail.

As shown in FIGS. 1-11, the pivoting mast device may further include a yoke mast 260 extending between a proximal end 262 and a distal end 264. A yoke pivot 266 pivotably couples the proximal end 262 of the yoke mast 260 with the mast coupler 70 for pivoting the yoke mast 260 between a vertical position 84 and a non-vertical position 86. As shown in FIGS. 4, 5, 8 and 9, upon the lower traveler 220 having a lower position relative to the upper mast portion 74, the lowering stay 240 engages with the distal end 264 of the yoke mast 260. The yoke mast 260 engagement with the lowering stay 240 greatly reduces the tension on the lowering stay 240 that would occur during the mast lowering displacement 244 and the mast raising displacement 246 absent the yoke mast 260. More specifically, the distal end 264 of the yoke mast 260 engages the lowering stay 240 during the yoke mast 260 in the vertical position 84 for supporting the mast 34 during a portion of the mast lowering displacement 244 and a portion of the mast raising displacement 246.

A forward support angle 270 is defined between the yoke mast 260 and the portion of the lowering stay 240 in front of the yoke mast 260. A rear support angle 272 is defined between the yoke mast 260 and the portion of the lowering stay 240 behind the yoke mass 260. Preferably, the forward support angle 270 and the rear support angle 272 defining an equivalent angle 274. The equivalent angle 274 assists in reducing tensile stress on the lowering stay 240, the yoke mast 260 and the lower traveler 220. Furthermore, the deck 24 and the lowering stay 240 define generally an equilateral triangle 276. The equilateral triangle 276 assists in descending and ascending the upper mast portion 74 in a controlled and supported manner.

Figure 10:
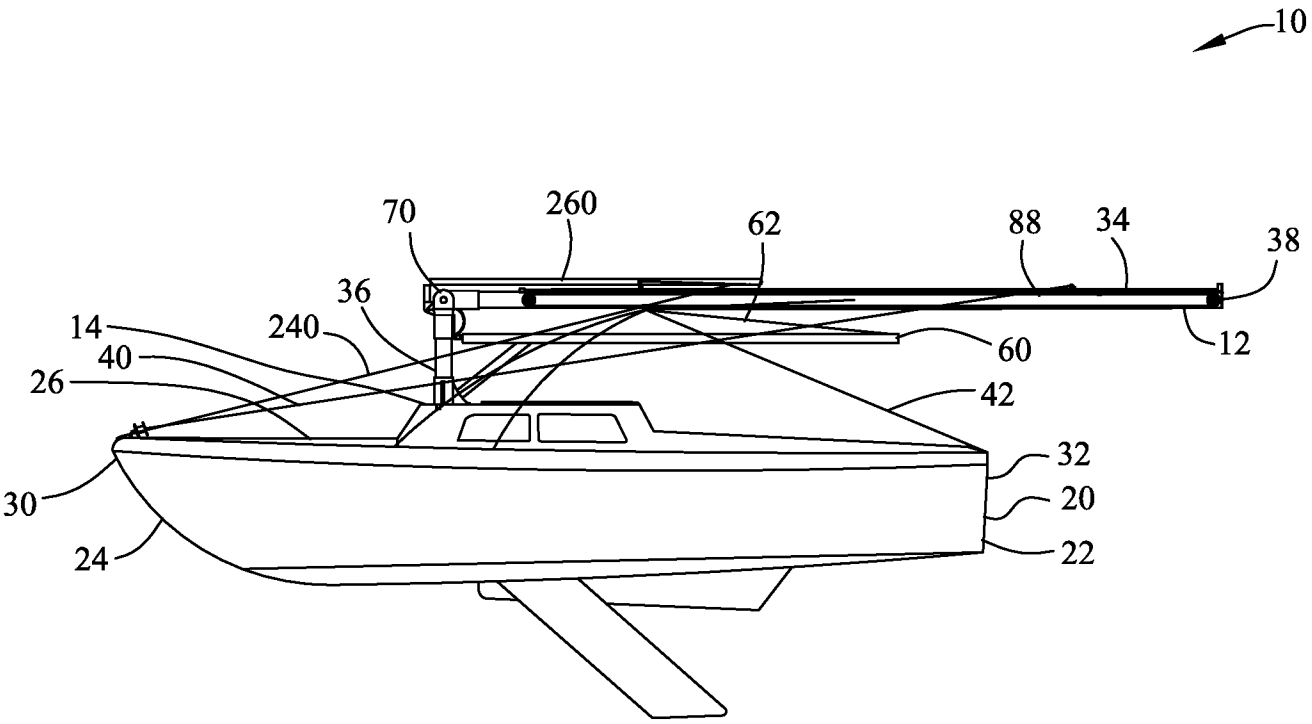
FIG. 10 is a view similar to FIG. 9 illustrating the yoke mast pivoting to a horizontal position.
Figure 11:
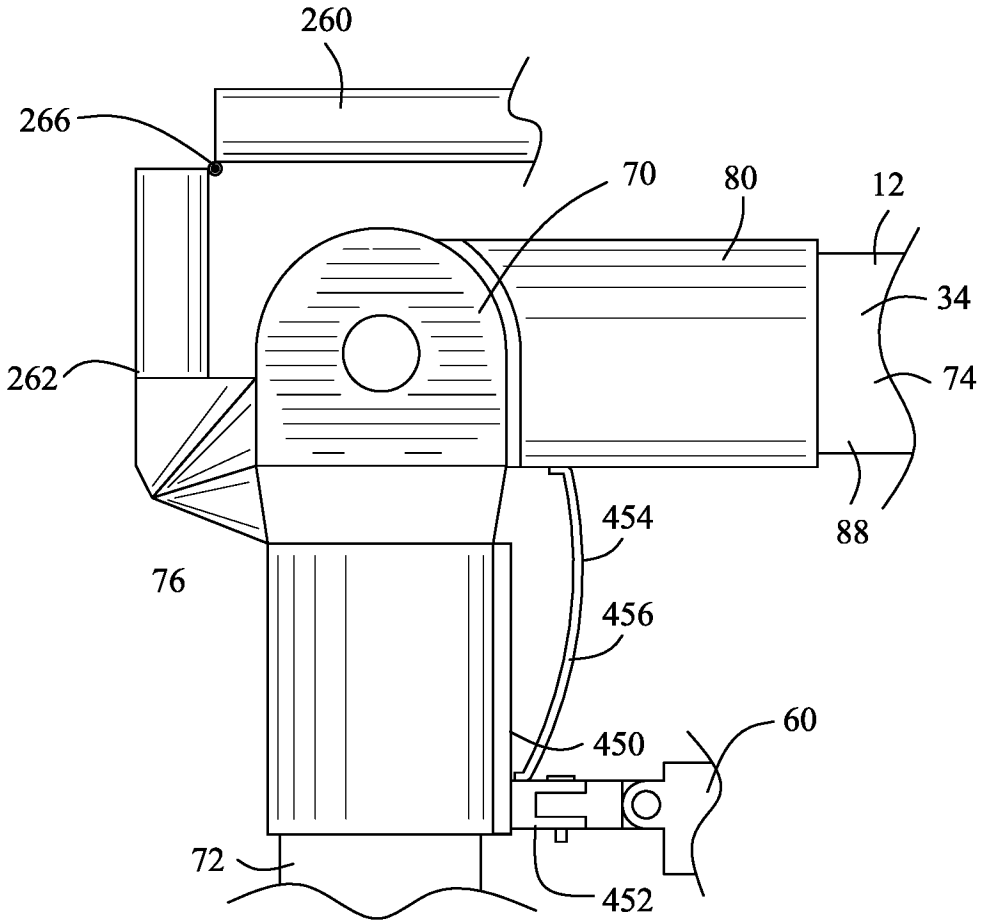
FIG. 11 is an enlarged portion of FIG. 10 illustrating the boom having a descending displacement relative to the boom slide.

As shown in FIG. 10, upon the upper mast portion 74 reaching a horizontal position 88, the yoke mast 260 may thereafter be pivoted upon the yoke pivot 266 for transitioning the yoke mast 260 from a vertical position 84 to a non-vertical position 86. In FIG. 10 the pivoting mast device 10 positions both the upper mast portion 74 and the yoke mast 260 in a horizontal position 88 for permitting the vessel 20 to define a lower height dimension 280 that is substantially reduced from the vessel having the mast 34 in a vertical position 84. The lower height dimension 280 will permit the vessel 22 to traverse under bridges, roads, or other low clearance obstructions.

FIGS. 15, 16, 26 and 27 illustrate the pivoting vessel mast device 10 including an upper traveler lock 300 coupled to the distal end 38 of the upper mast portion 72. More specifically, the upper traveler lock 300 is positioned within the upper track housing 152. The upper traveler lock 300 may include a bear claw latch 302 that is cable activated or electrically activated. The upper traveler 200 includes a locking arm 304 that extends above the upper traveler 200. The locking arm 304 engages the upper traveler lock 300 and thereafter the upper traveler lock 300 retains the locking arm 304 within the upper traveler lock 300 until disengagement. The locking arm 304 only engages with the upper traveler lock 300 during the upper mast portion 74 in the vertical position 84 for preventing the descending displacement of the upper traveler 200. The upper traveler lock 300 and locking arm 304 serve as a safety measure for maintaining the mast 34 in the vertical position 84 if the lower traveler 220 was inadvertently lowered relative to the upper mast portion 72 and causing a most lowering displacement 244.

Figure 14:
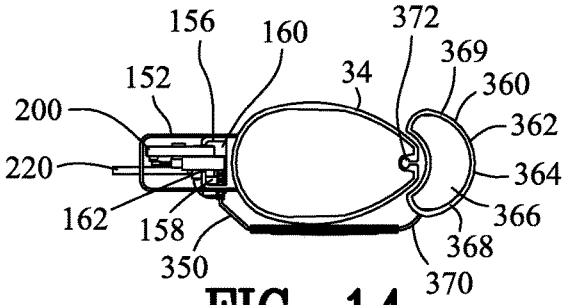
FIG. 14 is a top view of FIG. 13.

As shown in FIGS. 1, 4, 5, 7-10, 12-13 and 18-33, the pivoting mast device 10 may further include a second lower wheel 320 rotatably coupled approximate to the proximal end 36 of the mast 34 and a second upper wheel 322 rotatably coupled approximate to the mast coupler 70 on the upper mast portion 74. As shown in FIGS. 12-14 the second lower wheel 320 and the second upper wheel 322 may include a cord wheel 338. As shown in FIGS. 18-22 and 28-32 the second lower wheel 320 and the second upper wheel 322 may include a second sprocket 324. Alternatively, as shown in FIGS. 23-27 the lower wheel 100 and the upper wheel 102 include a second threaded sleeve 326.

A second linkage 330 couples the second lower wheel 320 to the second upper wheel 322. As shown in FIGS. 12-24 and 31-35, the second linkage 330 may include a second chain 332 encircling both the second sprockets 330 and defining a third vertical chain member 334 and a fourth vertical chain member 336. Alternatively, as shown in FIGS. 23-27 the second linkage 324 may include a second threaded rod 340 threadably engaging the second threaded sleeves 326.

A linkage bridge 342 couples the linkage 110 to the second linkage 330. The linkage bridge 342 translates any ascending displacement or descending displacement of the linkage 110 to the second linkage 330. The linkage bridge 342 in FIGS. 12-14 includes an exterior bridge bar 350. The linkage bridge 342 in FIGS. 18-22 and 28-35 includes an interior bridge bar 352. The linkage bridge 342 in FIGS. 23-27 includes a first top sprocket 354 coupled to the upper end of the threaded rod 118 and a second top sprocket 356 coupled to the upper end of the second threaded rod 340. A coupling chain 358 encircles the first top sprocket 354 with the second top sprocket 356 wherein rotation of the threaded rod 118 causes rotation of the second threaded rod 340 through the coupling chain 358.

A stay traveler 360 slidably engages the upper mast portion 72 and is coupled to the second linkage 330. In FIGS. 12-14 the stay traveler 360 is coupled to the second linkage 330 by a second exterior bridge bar 370. The stay traveler 360 in FIGS. 12-14 may be coupled to an existing mast 34 wherein the vessel was not originally constructed with the pivoting mast device 10. In FIGS. 18-35, the stay traveler 360 is coupled to the second linkage 330 by traversing a rear track groove 372 in the rear of the mast 34. The rear track groove 372 extends from approximate to and above the mast coupler 70 and to the distal end 38 of the mast 34. The stay traveler 360 may include a second plurality of upper wheels 374 rotatably coupled to the stay traveler for engaging the interior track.

Figure 7:
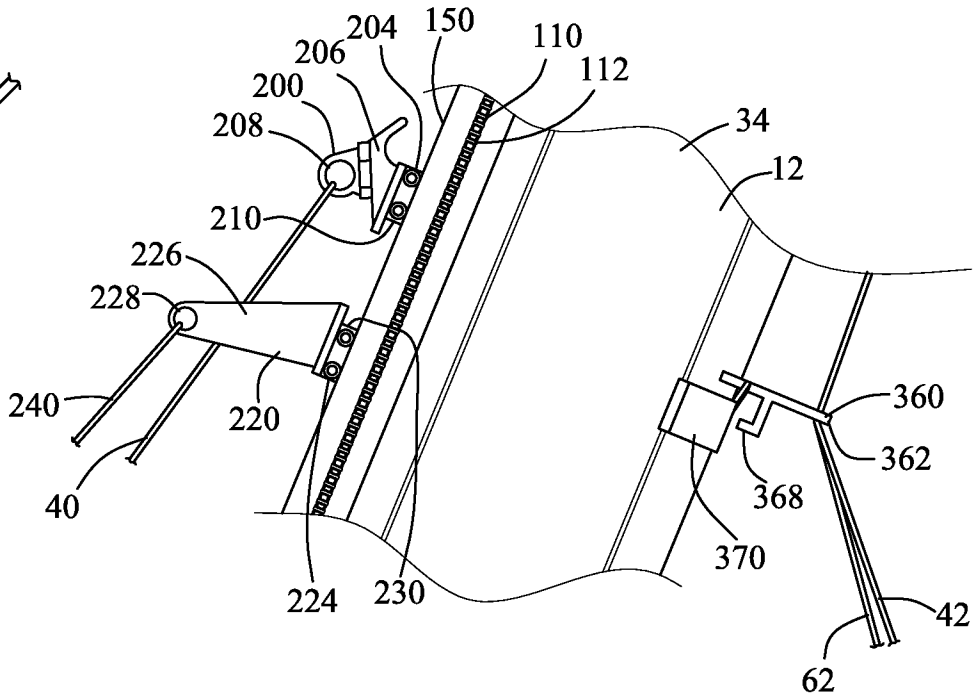
FIG. 7 is an enlarged portion of FIG. 4 illustrating a lower traveler separating from an upper traveler and a stay traveler maintaining a backstay adjacent to the mast.
Figure 6:
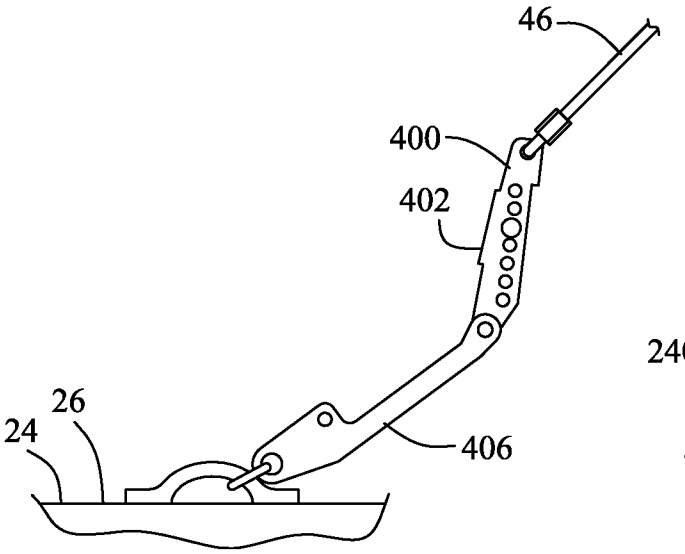
FIG. 6 is an enlarged portion of FIG. 5 illustrating a starboard stay extender in an extended length during the lowering displacement and a raising displacement.
Figure 8:
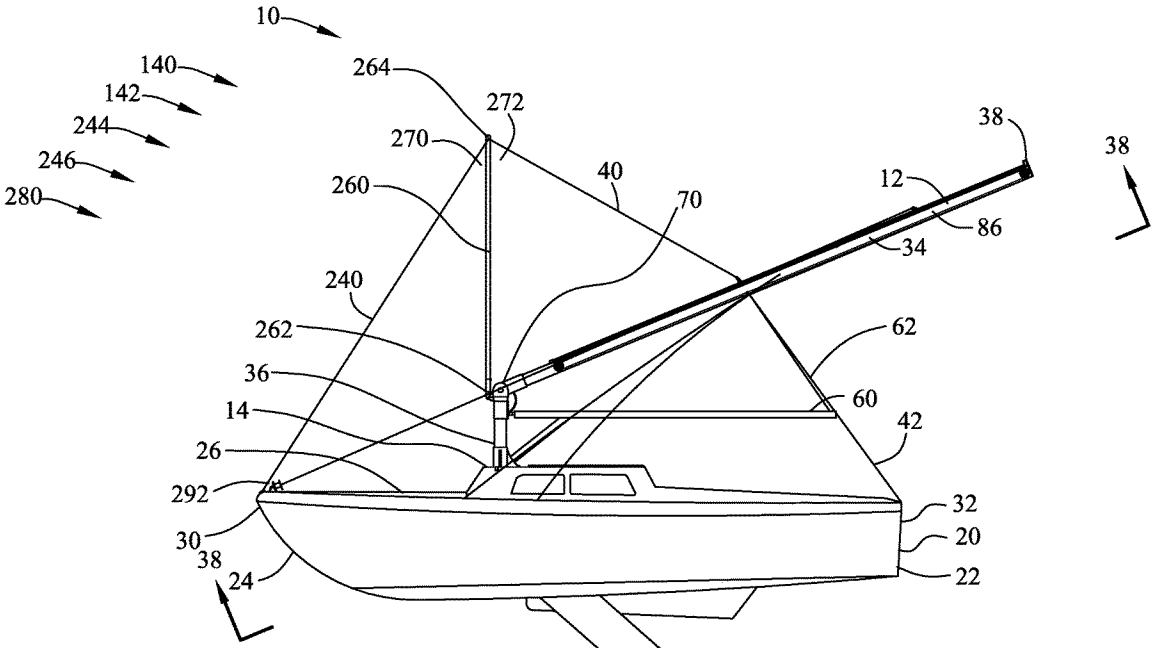
FIG. 8 is a view similar to FIG. 5 illustrating the mast having a further partially lowering displacement from a vertical position.
Figure 9:
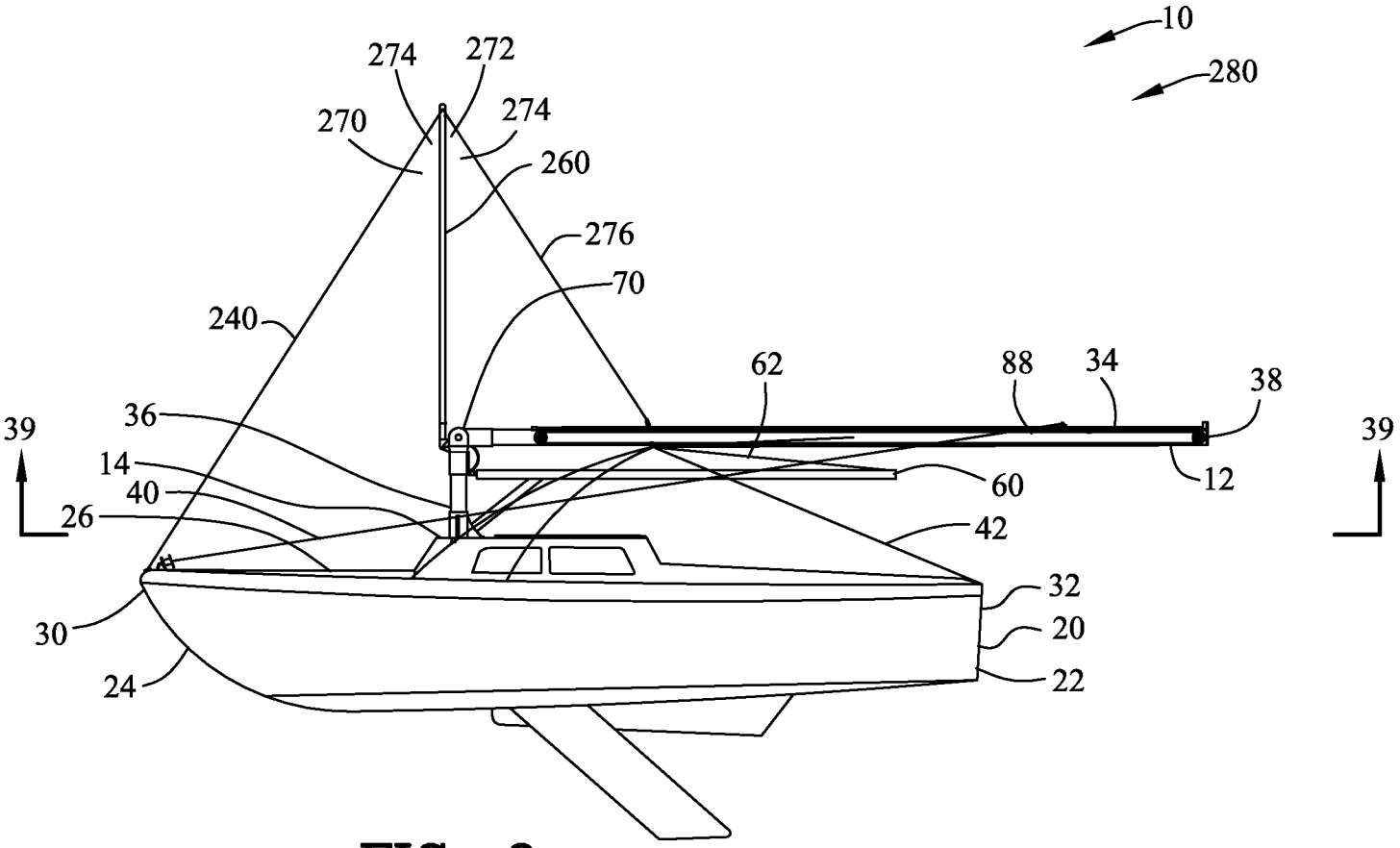
FIG. 9 is a view similar to FIG. 8 illustrating the mast having a further partially lowering displacement into a horizontal position.

The stay traveler 360 in FIGS. 18-35 may be coupled to a newly constructed mast 34 wherein the vessel was originally constructed with the pivoting mast device 10. A stay arm 362 extends from the stay traveler 360. The stay arm 362 may include a bulbous annular frame 364 defining an arm aperture 366. The backstay 42 traverses the arm aperture 366 as best seen in FIG. 7 wherein the stay arm 362 engaging the backstay 42 during a portion of the mast lowering displacement 244 and a portion of the mast raising displacement 246 for maintaining the backstay 42 adjacent to the upper mast portion 74. By maintaining the backstay 42 adjacent to the upper mast portion 74 wherein the upper mast portion 72 is in the non-vertical position 86 assures the backstay 72 will less likely be tangled or interfere with any foreign objects.

As shown in FIGS. 36-39 the pivoting mast device 10 may include an outer starboard tether 390 extending from the outer starboard sidestay 44 and the upper mast portion 74. A rear lower starboard tether 392 extends from the rear lower starboard sidestay 48 and the upper mast portion 74. An outer port tether 394 extends from the outer port sidestay 50 and the upper mast portion 74. A rear lower port tether 396 extends from the rear lower port sidestay 54 and the upper mast portion 74.

As best shown in FIGS. 7, 13, 19, 21, 22, 24, 26, 27, 29, 31, 32 and 36-39, the stay arm 362 may include a first J-shaped hook 368 and a second J-shaped hook 369. The outer starboard tether 390 and the outer port tether 394 engage the first J-shaped hook 368 and the second J-shaped hook 369 of the stay arm 362 respectively during a portion of the mast lowering displacement 244 and a portion of the mast raising displacement 246 for maintaining the outer starboard sidestay 44 and the outer port sidestay 50 adjacent to the upper mast portion 74.

Similarly, the rear lower starboard tether 392 and the rear lower port tether 396 engage the first J-shaped hook 368 and the second J-shaped hook 369 of the stay arm 362 respectively during a portion of the mast lowering displacement 244 and a portion of the mast raising displacement 246 for maintaining the rear lower starboard sidestay 48 and the rear lower port sidestay 54 adjacent to the upper mast portion 74. By maintaining the outer starboard sidestay 44, the outer port sidestay 50, the rear lower starboard sidestay 48 and the rear lower port sidestay 54 adjacent to the upper mast portion 74 wherein the upper mast portion 72 is in the non-vertical position 86 assures the outer starboard sidestay 44, the outer port sidestay 50, the rear lower starboard sidestay 48 and the rear lower port sidestay 54 are less likely be tangled or interfere with any foreign objects.

In order to facilitate the upper mast portion 74 to freely pivot about the mast pivot 76 from the vertical position 84 to the non-vertical position 86, the pivoting mast device 10 may include a starboard stay extender 400 coupling the front lower starboard sidestay 46 to the deck 26. Similarly, a port stay extender 402 may couple the front lower port sidestay 52 to the deck 26. The starboard stay extender 400 and the port stay extender 402 having a reduced length 404 and an extended length 406. The starboard stay extender 400 and the port stay extender 402 have the reduced length 404 during the upper mast portion 74 having the vertical position 84 for defining a tension is the front lower starboard sidestay 46 and the front lower port sidestay 52. The starboard stay extender 400 and the port stay extender 402 has the extended length 406 during the mast lowering displacement 244 and the mast raising displacement 246 for permitting pivoting of the upper mast portion 74 about the mast pivot 76.

As shown in FIGS. 28-34, the pivoting mast device 10 may further include a stay spring 420 extending between an upper end 422 and a lower end 424. The upper end 422 is coupled approximate to the distal end 38 of the upper mast portion 74. A spring bar 426 is coupled to the lower end 424. The spring bar 426 includes a key arm 427 for slidably engaging a key slot 429 within the mast 34 and maintaining alignment of the spring bar 426 relative to the stay spring 420. A spring arm 426 extends from the lower traveler 220 for abutting against the spring bar 426.

A front lower starboard sidestay extension 430 couples with the front lower starboard sidestay 46 for defining a front elongated lower starboard sidestay 432 extending between the deck 26 and the stay spring 420. A front lower port sidestay extension 434 couples with the front lower port sidestay 52 for defining a front elongated lower port sidestay 436 extending between the deck 26 and the stay spring 420.

The spring arm 428 engages the spring bar 426 and compresses the stay spring 420 during the upper mast portion 72 in the vertical position 84 for tensioning the front elongated lower starboard sidestay 432 and the front elongated lower port sidestay 436. The spring arm 428 disengaging the spring bar 426 and permitting the expansion of the stay spring 420 during the mast lowering displacement 244 for removing the tension from the front elongated lower starboard sidestay 432 and the front elongated lower port sidestay 436 and permitting pivoting of the upper mast portion 74 about the mast pivot 76. In order to facilitate the transition of the front elongated lower starboard sidestay 432 and the front elongated lower port sidestay 436 from the interior of the mast 34 to the exterior of the mast 34, the mast 34 may include a first sidestay pulley wheel 440 and a second sidestay pulley wheel 442 secured within the mast 34. In addition, a first sidestay aperture 444 and a second sidestay aperture 446 are positioned adjacent to the first sidestay pulley wheel 440 and the second sidestay pulley wheel 442 for receiving the front elongated lower starboard sidestay 432 and the front elongated lower port sidestay 436 respectively.

As shown in FIGS. 1-11, the pivoting mast device 10 may further include a boom slide 450 coupled to the mast coupler 70. A slide arm 452 extends from the boom 60 and slidably engages the boom slide 450 for altering the elevation of the boom 60. A boom linkage 454 couples the upper mast portion 74 with the boom 60 for defining a descending displacement of the boom 456 during the mast lowering displacement 244 relative to the boom slide 450 and defining an ascending displacement of the boom 458 during the mast raising displacement 246 relative to the boom slide 450.

FIGS. 40-55 illustrating a fifth embodiment of the pivoting mast device 10. The pivoting mast device 10 as illustrated in FIGS. 40-55 functions similarly to the pivoting mast device 10 as shown in FIGS. 12-17. The fifth embodiment of the pivoting mast device 10 as shown in FIGS. 40-55 includes an exterior pivoting mast device 470. The exterior pivoting mast device 470 is intended to be installed to an existing mast 34 wherein the vessel was not originally constructed with the pivoting mast device 10. The exterior pivoting mast device 470 includes an exterior housing 472 having a concave interior side 474, a primary side 476, a secondary side 478 and an exterior side 480. The exterior housing 472 extends between an upper end 490 and a lower end 492.

Preferably, the curvature of the concave interior side 474 matches the front arcuate side of the mast 34 for providing a continuous abutment between the concave interior surface for 74 and the front arcuate side of the mast 34. The exterior housing 472 may be fastened to the mast 34 by welding bolting or other fasteners.

The secondary side 478 of the exterior housing 472 includes a first upper conduit aperture 494 and a first lower conduit aperture 496. The mast 34 includes a second upper conduit aperture 500 and a second lower conduit aperture 502. An upper exterior conduit 504 engages between the first upper conduit aperture 494 and the second upper conduit aperture 500. A lower exterior conduit 506 engages between the first lower conduit aperture 496 and the second lower conduit aperture 502. A tether 518 extends from the stay traveler 360, through the upper exterior conduit 504, through the exterior housing 472, through the lower exterior conduit 506 through the rear track groove 372 and back into the stay traveler 360. The tether 518 is coupled to the linkage 110 by a tether coupler 520.

In order to facilitate the transitioning of the tether 518 from the upper exterior conduit 504, a first upper interior pulley 510 may be secured adjacent to the upper end 490 and within the exterior housing 472 and a second upper interior pulley 514 may be secured adjacent to the distal end 38 and within the mast 34. Furthermore, in order to facilitate the transitioning of the tether 518 from the lower exterior conduit 506, a first lower interior pulley 512 may be secured adjacent to the lower end 492 and within the exterior housing 472 and a second lower interior pulley 516 may be secured adjacent to the proximal end 36 and within the mast 34.

The exterior housing 472 encapsulates the linkage 110, the lower wheel 100, the upper wheel 102 and a majority of the upper traveler 200 and the lower traveler 220 in order for prevent contact and/or jamming between the pivoting mast device 10 and any items from the vessel 20 including but not limited to lines, sails or other items.

The pivoting mast device 10 may further include a first exterior sidestay pulley wheel 522 for facilitating the transition of the front lower starboard sidestay extension 430 through the first sidestay aperture 444. Similarly, the pivoting mast device 10 may further include a second exterior side stay pulley wheel 524 for facilitating the transition of the front lower port sidestay extension 434 through the second sidestay aperture 446.

The subject invention further includes a method for pivoting an elongated body 12 relative to a surface 14. The method comprising the steps of activating a drive 120 coupled to a mast 34 for displacing a linkage 110 in a descending direction. A lower traveler 220 is slideably displaced engaging the mast 34 and coupled to the linkage 110. An upper traveler 200 is slideably displaced engaging the mast 34 and coupled to the headstay 40. The mast 34 is then pivoted on a mast pivot 76 in a mast lowering displacement 244 defined by the lower traveler 220 and the upper traveler 200 in the descending direction from the vertical position 84 to the non-vertical position 86.

An additional step of the method for the subject invention further includes the step of pivoting the mast 34 on the mast pivot 76 in a mast raising displacement 246 defined by the lower traveler 220 in the ascending direction from the non-vertical position 86 to the vertical position 84.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A pivoting vessel mast device for a vessel, the vessel having a hull extending from a bow to a stern, the hull supports a mast extending between a proximal end and a distal end, a headstay, a backstay, a starboard sidestay and a port sidestay extend from the mast to the hull, the pivoting vessel mast device, comprising:

a mast pivot pivotably coupling the proximal end of the mast to the hull between a vertical position and a non-vertical position;

a lower wheel rotatably coupled approximate to the proximal end of the mast;

an upper wheel rotatably coupled approximate to the distal end of the mast;

a linkage coupling said lower wheel to said upper wheel;

a drive coupled to said lower wheel for displacing said linkage in a descending direction or an ascending direction relative to the mast;

an upper traveler slideably engaging the mast and coupled to the headstay;

a lower traveler slidably engaging the mast and coupled to said linkage;

a lowering stay secured to the bow and said lowering traveler;

a vertical mast lock defined by said lower traveler abutting said upper traveler during said upper traveler approximate to the distal end of the mast and the headstay, the backstay and said lowering stay in tension;

a mast lowering displacement defined by said lower traveler and said upper traveler in said descending direction for pivoting the mast from said vertical position to said non-vertical position; and a mast raising displacement defined by said lower traveler in said ascending direction for pivoting the mast from said non-vertical position to said vertical position.

2. A pivoting vessel mast device for a vessel as set forth in claim 1, further including a yoke mast extending between a proximal end and a distal end;

a yoke pivot pivotably coupling said proximal end of said yoke mast with said mast pivot for pivoting said yoke mast between a vertical position and a non-vertical position; and said distal end of said yoke mast engaging said lowering stay during said yoke mast in said vertical position for supporting the mast during a portion of said mast lowering displacement and a portion of said mast raising displacement.

3. A pivoting vessel mast device for a vessel as set forth in claim 1, further including an upper traveler lock coupled to the distal end of the mast;

a locking arm extending from said upper traveler; and said locking arm engaging said upper traveler lock during the mast in said vertical position for preventing the descending displacement of said upper traveler.

4. A pivoting vessel mast device for a vessel as set forth in claim 1, further including a second lower wheel rotatably coupled approximate to the proximal end of the mast;

a second upper wheel rotatably coupled approximate to the distal end of the mast;

a second linkage coupling said second lower wheel to said second upper wheel;

a linkage bridge coupling said linkage to said second linkage;

a stay traveler slidably engaging the mast and coupled to said second linkage; and a stay arm extending from said stay traveler; and said stay arm engaging the backstay during a portion of said mast lowering displacement and a portion of said mast raising displacement for maintaining the backstay adjacent to the mast.

5. A pivoting vessel mast device for a vessel as set forth in claim 4, further including a starboard tether extending from the starboard sidestay and the mast;

a port tether extending from the port sidestay and the mast; and said starboard tether and said port tether engaging said stay arm during a portion of said mast lowering displacement and a portion of said mast raising displacement for maintaining the starboard sidestay and the port sidestay adjacent to the mast.

6. A pivoting vessel mast device for a vessel as set forth in claim 1, further including an exterior track coupled to the mast and extending approximate to the distal end and the proximate end of the mast;

a plurality of upper wheels rotatably coupled to said upper traveler for engaging said exterior track; and a plurality of lower wheels rotatably coupled to said lower traveler for engaging said exterior track.

7. A pivoting vessel mast device for a vessel as set forth in claim 1, further including an interior track coupled within the mast and extending approximate to the distal end and the proximate end of the mast;

a plurality of upper wheels rotatably coupled to said upper traveler for engaging said exterior track; and a plurality of lower wheels rotatably coupled to said lower traveler for engaging said exterior track.

8. A pivoting vessel mast device for a vessel, the vessel having a hull extending from a bow to a stern, the hull supports a mast extending between a proximal end and a distal end, a headstay and a backstay extend from the mast to the hull, the pivoting vessel mast device, comprising:

a mast pivot coupled approximate to the proximal end of the mast for pivoting the mast between a generally vertical position and a non-vertical position;

a lower wheel rotatably coupled approximate to the proximal end of the mast;

an upper wheel rotatably coupled approximate to the distal end of the mast;

a linkage coupling said lower wheel to said upper wheel;

a drive coupled to said linkage for displacing said linkage in a descending direction or an ascending direction relative to the mast;

an upper traveler slideably engaging the mast and coupled to the headstay;

a lower traveler slidably engaging the mast and coupled to said linkage;

a lowering stay secured to the bow and said lowering traveler;

a mast lowering displacement defined by said lower traveler and said upper traveler in said descending direction for pivoting the mast from said generally vertical position to said non-vertical position; and a mast raising displacement defined by said lower traveler and said upper traveler in said ascending direction for pivoting the mast from said non-vertical position to said generally vertical position.

9. A pivoting vessel mast device for a vessel as set forth in claim 8, further including a vertical mast lock defined by said lower traveler abutting said upper traveler during said upper traveler approximate to the distal end of the mast and the headstay, the backstay and said lowering stay in tension.

10. A pivoting vessel mast device for a vessel, the vessel having a hull extending from a bow to a stern, the vessel supports a mast extending between a proximal end and a distal end, a headstay and a backstay extend from the mast to the vessel, the pivoting vessel mast device, comprising:

a mast pivot pivotably coupling the mast to the vessel between a generally vertical position and a non-vertical position;

a lower wheel rotatably coupled approximate to the proximal end of the mast;

an upper wheel rotatably coupled approximate to the distal end of the mast;

a linkage coupling said lower wheel to said upper wheel;

a drive coupled to said linkage for displacing said linkage in a descending direction or an ascending direction relative to the mast;

a traveler slideably engaging the mast and coupled to the headstay and said linkage;

a mast lowering displacement defined by said traveler in said descending direction for pivoting the mast from said generally vertical position to said non-vertical position; and a mast raising displacement defined by said traveler in said ascending direction for pivoting the mast from said non-vertical position to said generally vertical position.

* * * * *